US007878507B1

(12) United States Patent
Dimond

(10) Patent No.: US 7,878,507 B1
(45) Date of Patent: Feb. 1, 2011

(54) SPATIAL GAME APPARATUS

(76) Inventor: John Joseph Dimond, 2925 Southmoor Dr., Fort Collins, CO (US) 80525

( * ) Notice: Subject to any disclaimer, the term of this patent is extended or adjusted under 35 U.S.C. 154(b) by 154 days.

(21) Appl. No.: 12/322,948

(22) Filed: Feb. 9, 2009

(51) Int. Cl.
*A63F 9/06* (2006.01)

(52) U.S. Cl. ..... 273/153 S; 273/153 R

(58) Field of Classification Search ..... 273/153 R, 273/153 S, 109, 113, 118 R
See application file for complete search history.

(56) References Cited

U.S. PATENT DOCUMENTS

| | | | | | |
|---|---|---|---|---|---|
| 3,075,770 | A | | 1/1963 | Young | |
| 3,406,971 | A | | 10/1968 | Koff | |
| 3,540,731 | A | | 11/1970 | Muncey | |
| 3,625,516 | A | * | 12/1971 | Handweiler et al. | 273/153 R |
| 3,785,651 | A | * | 1/1974 | Smith | 273/113 |
| 4,150,829 | A | | 4/1979 | Cates | |
| 4,494,753 | A | | 1/1985 | Wampler | |
| 4,545,577 | A | | 10/1985 | Randleman | |
| 4,570,935 | A | * | 2/1986 | Stefanini | 273/153 R |
| 4,743,023 | A | * | 5/1988 | Collier | 273/113 |
| 4,759,547 | A | | 7/1988 | Shin-Tao | |
| 4,861,036 | A | | 8/1989 | Watanabe | |
| 4,953,863 | A | | 9/1990 | Zeidler | |
| 5,096,198 | A | | 3/1992 | Cook | |
| 5,123,650 | A | | 6/1992 | Slauter | |
| 5,201,524 | A | | 4/1993 | Csanady | |
| 5,494,292 | A | | 2/1996 | Mileti | |
| 5,839,723 | A | * | 11/1998 | Grimes | 273/109 |
| 6,523,825 | B2 | | 2/2003 | Francis | |

* cited by examiner

*Primary Examiner*—Steven Wong

(57) ABSTRACT

A game apparatus with passageways for object passage. Some portions consist of stationary pieces. Each of these contains a plurality of passageways. Other portions consist of multiple pieces. Some of these can be moved and others cannot be moved. Those pieces that can be moved contain a plurality of passageways. The operator of the game moves these pieces via handles. In each position the passageways in the moveable pieces align with passageways in either the portions above or below. As alignments occur, objects drop from one portion to the one below. Mechanisms cause the movement of some pieces to transfer to other pieces. Below the lowest portion are two collection trays on opposite sides of the assembly. By manipulating the movable pieces game operators can cause objects to move down through the apparatus into the collection trays.

1 Claim, 32 Drawing Sheets

SPATIAL GAME APPARATUS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

This application relates to games and puzzles of spatial logic that involve moving game objects within or through an apparatus.

2. Prior Art

Within the field of games and puzzles there exist games and puzzles that require the application of spatial logic in the manipulation of apparatus pieces or parts. These may or may not be linked via mechanisms to achieve a desired result or determine specific information about the apparatus. There are also games and puzzles that utilize gravity in conjunction with parts and mechanisms to allow for the movement of game objects through the game.

Puzzles and games that involve spatial logic are well known. Puzzles comprised of tiles secured in a base so that the tiles can be maneuvered in two dimensions around one another until a particular pattern is achieved are common. Puzzles where pieces are mechanically secured to one another so that they can be maneuvered in three dimensions until a particular pattern is achieved are well known under the name Rubik's Cube. The challenge in these puzzles is to determine the sequence of moves to achieve the desired result. Once the player has determined the necessary sequence or family of sequences the challenge is mastered.

U.S. Pat. No. 3,540,731 (1970), MUNCEY, discloses a puzzle maze where the player moves a ball through a maze located under a clear cover that can be reconfigured. U.S. Pat. No. 6,523,825 (2003), FRANCIS, discloses a spatial game toy where pieces are mechanically secured to one another. These pieces then may be maneuvered in three dimensions to change the alignment of holes in the pieces to create a dynamic maze for an object inserted into the game toy. U.S. Pat. No. 5,096,198 (1992), COOK, discloses a mechanical game device that requires spatial logic. The device has removable parts that can be inserted into the device in various patterns to create different internal pathways for balls to be inserted into the device. The player is then to determine the specific internal pathways created based on how the balls exit the device despite not being able to see the pathways. These puzzles add either the ability to create multiple versions of the same puzzle or a new dimension or factor in the puzzle. These new factors increase the challenge. The basic challenge is of the same type as those in the previous paragraph.

Puzzles and games that involve the use of gravity and mechanisms to manipulate the path of a game object are well known. These games or puzzles utilize either, or both, skill and strategy. A common game of skill in this realm is marketed under the name "Labyrinth" by Brio. Labyrinth requires the player to tilt a tray containing a maze defined by walls within the tray and random holes through the tray so that a ball travels through the maze without falling into the holes. U.S. Pat. No. 3,075,770 (1963), YOUNG, discloses a puzzle game of skill where the player manipulates an assembly so that a ball travels through a three dimensional maze. In the 1960's Milton Bradley marketed a skill puzzle game under the name of Tilt'n Roll that combined a three dimensional maze with holes to be avoided. U.S. Pat. No. 4,545,577 (1985), RANDLEMAN, discloses a maze game device where a game object is moved through a three-dimensional maze by orienting the game housing and depressing external buttons protruding from the game housing. These puzzle and games introduce varying combinations of skill and strategy. Despite these varying levels the player can master the game or puzzle.

In the 1950's Shaper marketed a spatial logic game under the name of Stadium Checkers where players moved marbles down into a bowl shaped game apparatus where the internal surface is comprised of concentric rings. The surfaces of these rings were formed with features that the marbles could roll into and from. Players would then rotate the rings causing the marbles to move down through the rings. The goal of each player was to cause his or her marbles, as identified by color, to move from the top level of the game apparatus to a specific location at the bottom center of the game apparatus, before the other players accomplished the same task. U.S. Pat. No. 5,494,292 (1996), Mileti, discloses a device consisting of a stack of alternately rotatable and stationary discs. The discs have passageways through which players can move their game object down and through the device in a race to the bottom. These games introduce the additional challenge of opposing players. This challenge is played in a relatively simple apparatus. In these apparatus the possible sequence of moves can be mastered by experienced players well enough to allow them to win based on the advantage of the first move.

SUMMARY

The embodiment presents an apparatus with a stationary frame and moving pieces. Players manipulate the moving pieces causing Game Objects to move down through the apparatus into two different collection trays. Interactions between some of the moving pieces balance and complicate the challenge presented to the two players.

DRAWINGS

Figures

Figure 7:
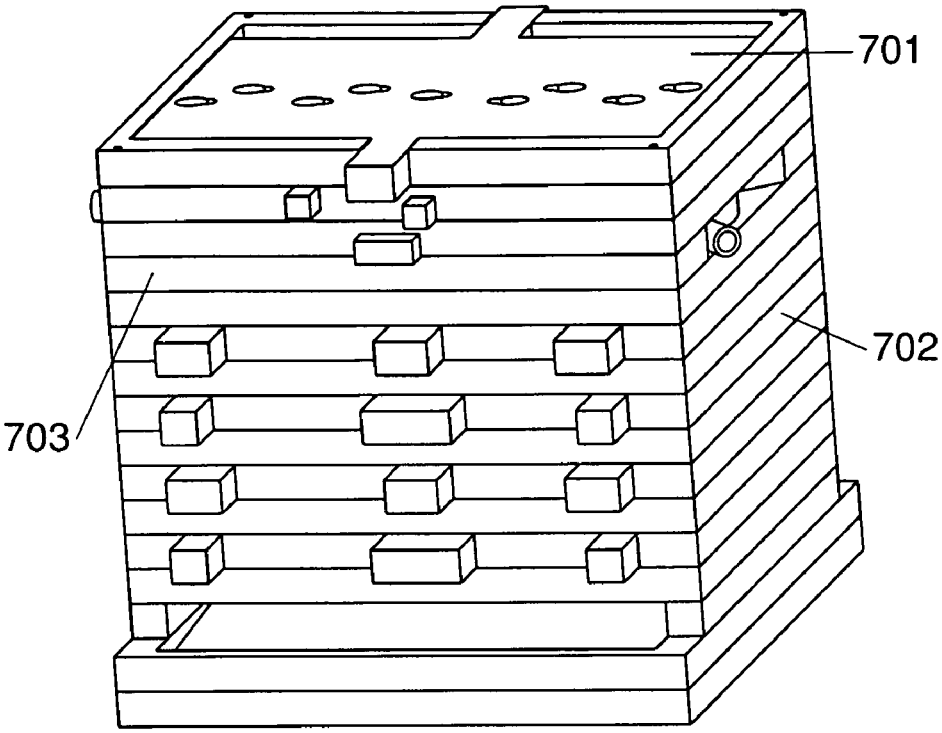
FIG. 7 is a perspective view of the front of the apparatus.
Figure 7A:
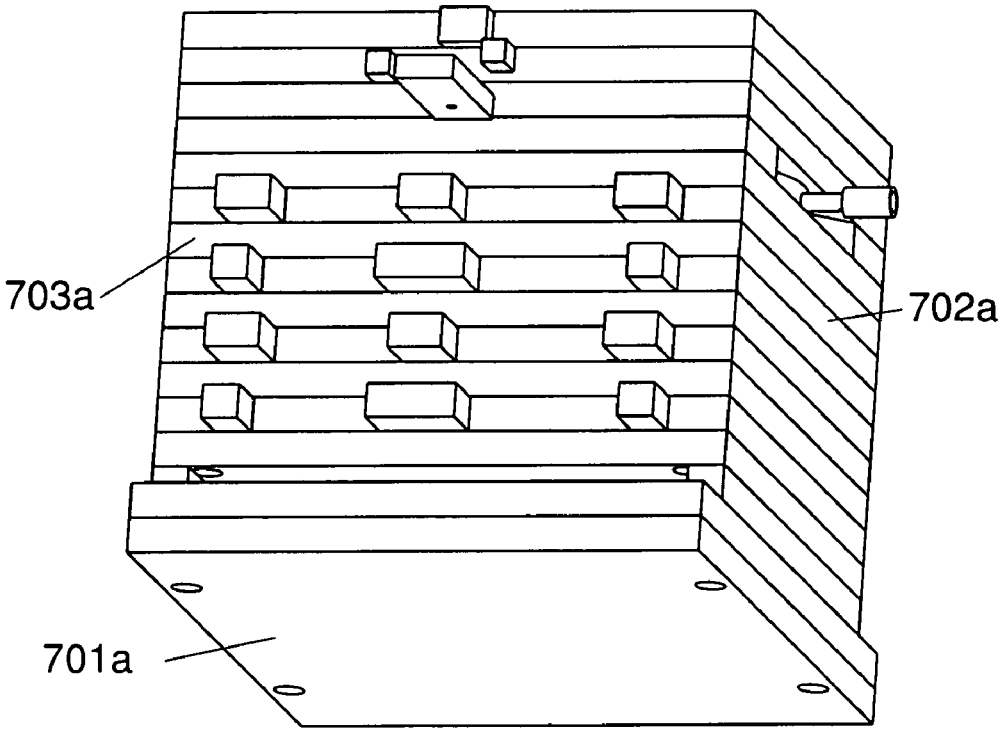

FIG. 7*a* is a perspective view of the back of the apparatus.

Figure 8:
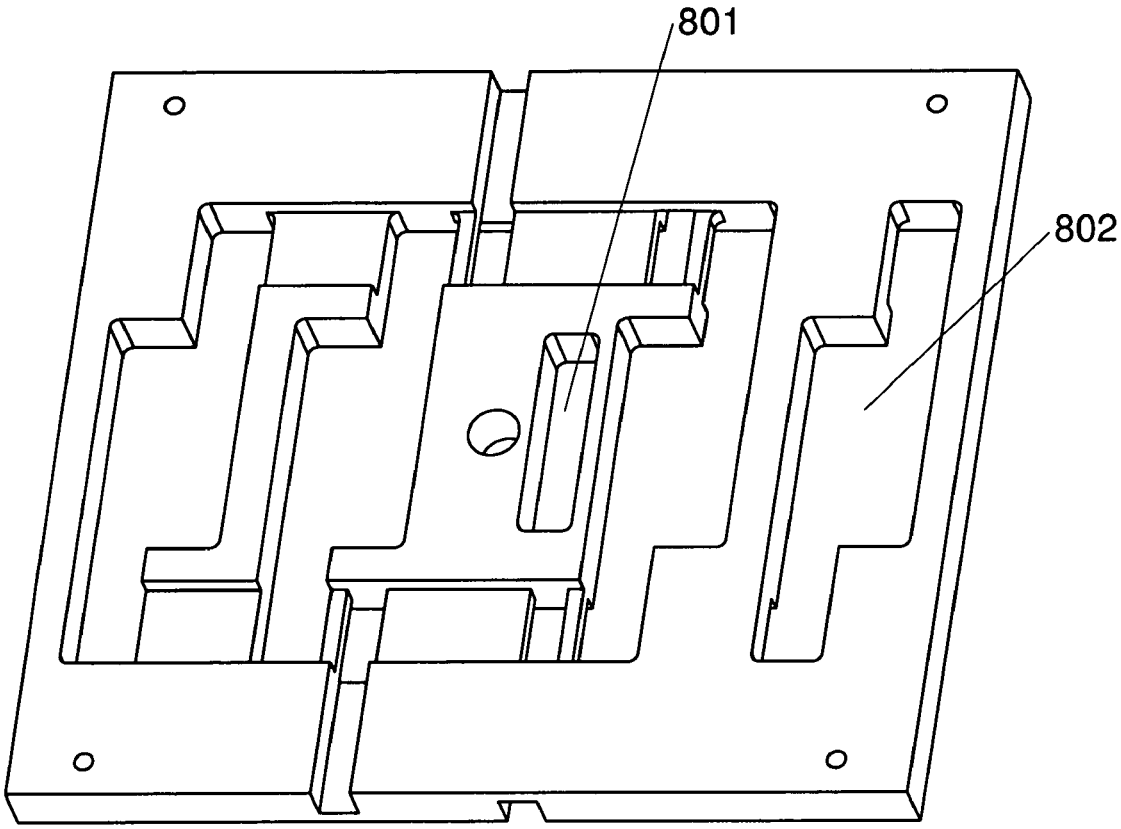

FIG. 8 is a perspective view of a stationary piece of the apparatus.

Figure 9:
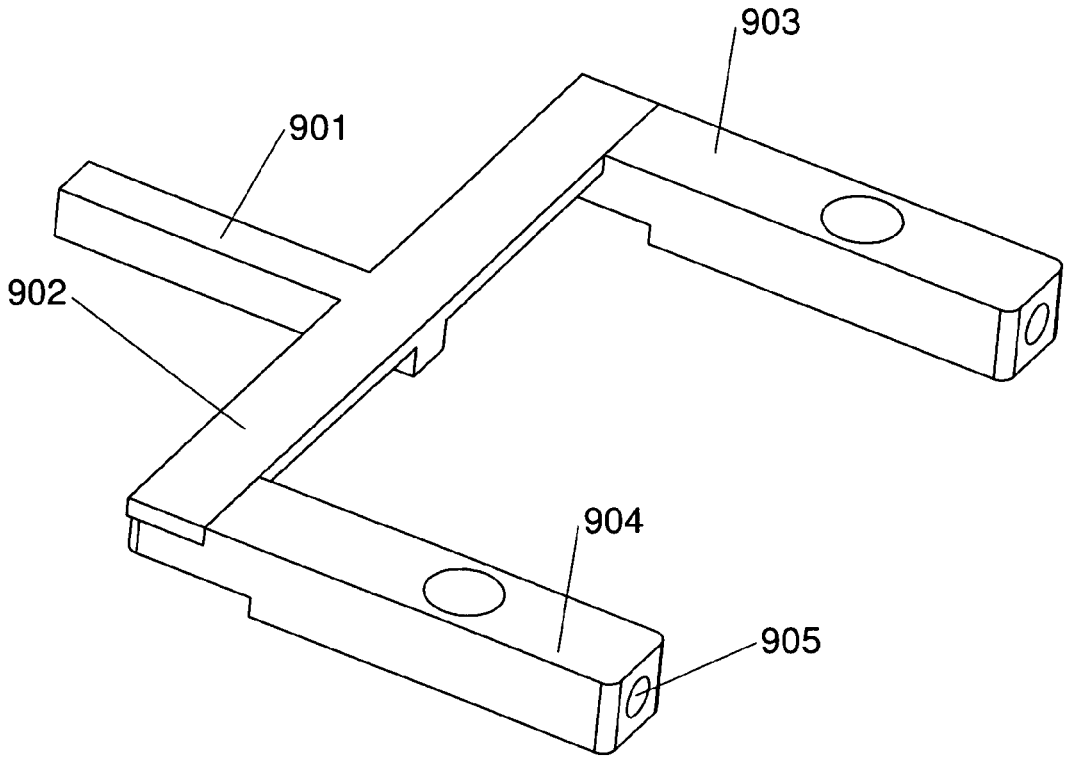

FIG. 9 is a perspective view of an internal assembly of the apparatus.

Figure 10:
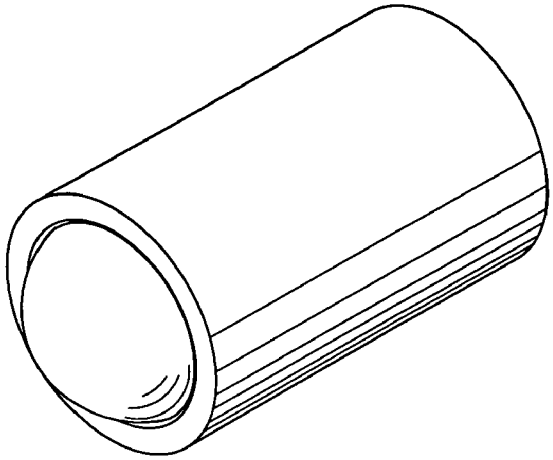

FIG. 10 is a perspective view of an internal assembly of the apparatus.

Figure 11:
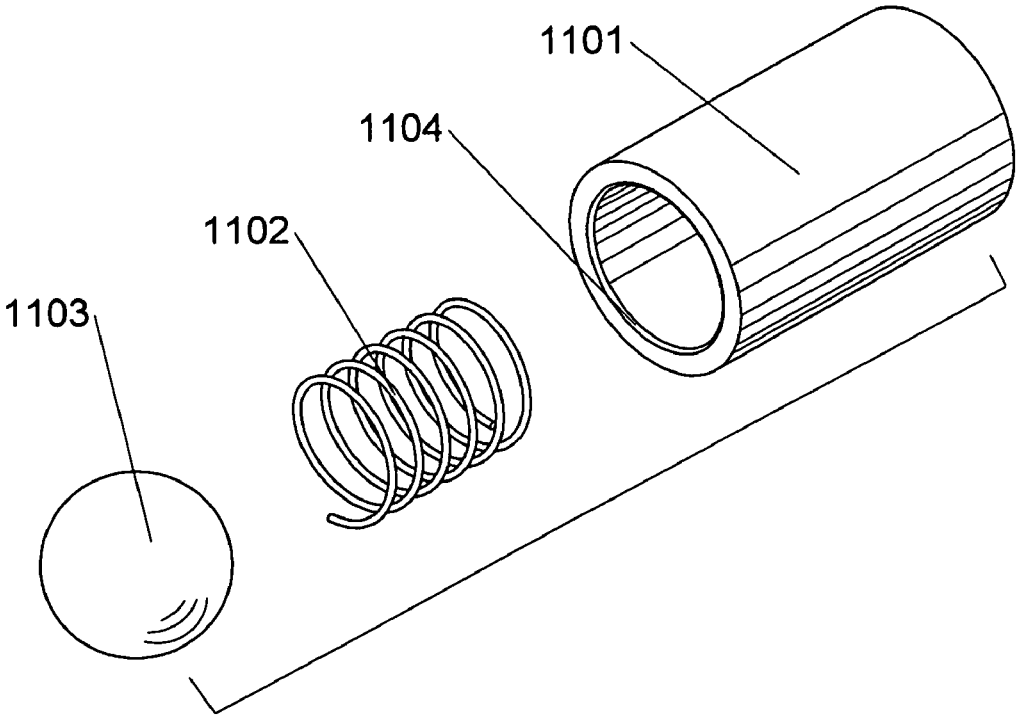

FIG. 11 is an exploded perspective view of the assembly depicted in FIG. 10.

Figure 12:
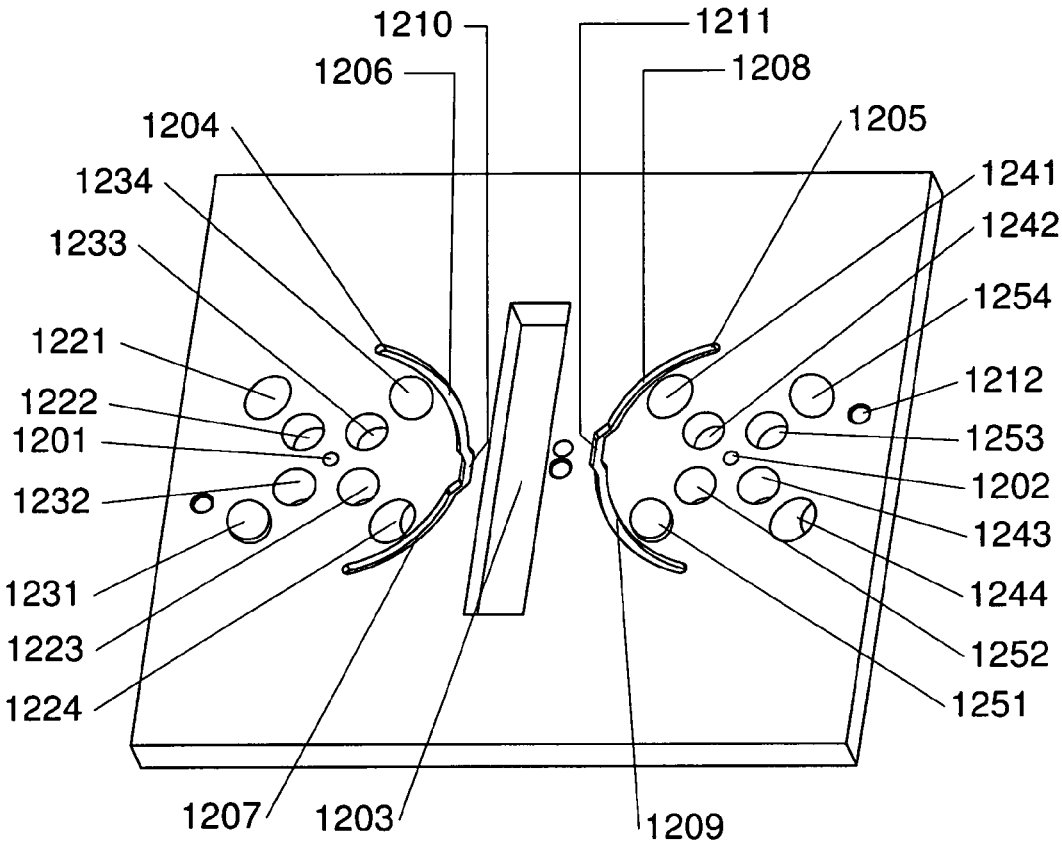

FIG. 12 is a perspective view of a stationary piece of the apparatus.

Figure 13:
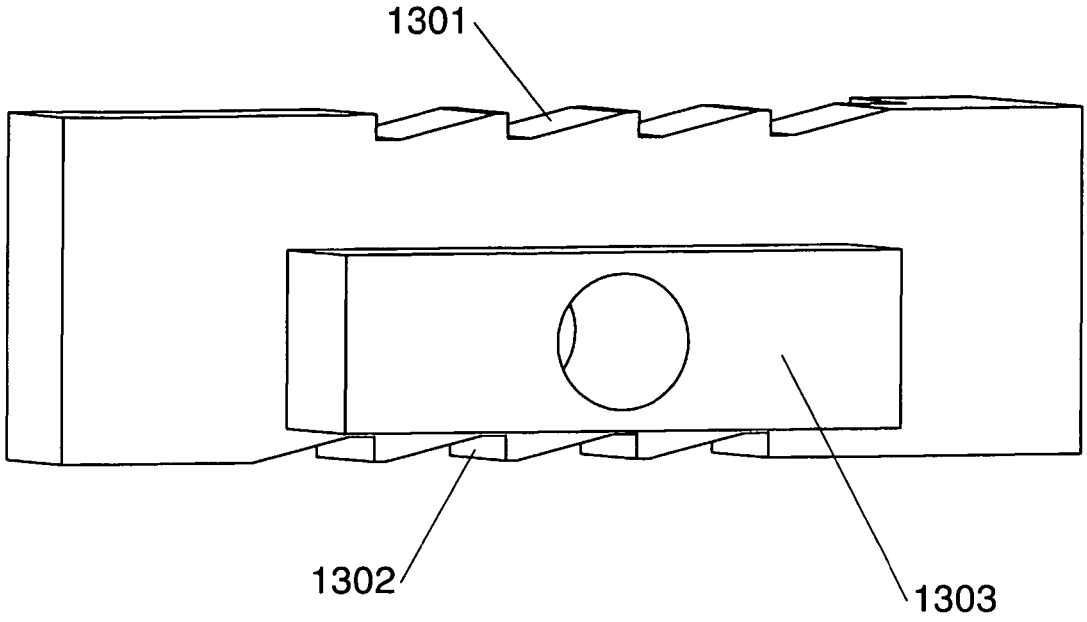

FIG. 13 is a perspective view of the bottom of one of the moveable pieces in the apparatus.

Figure 14:
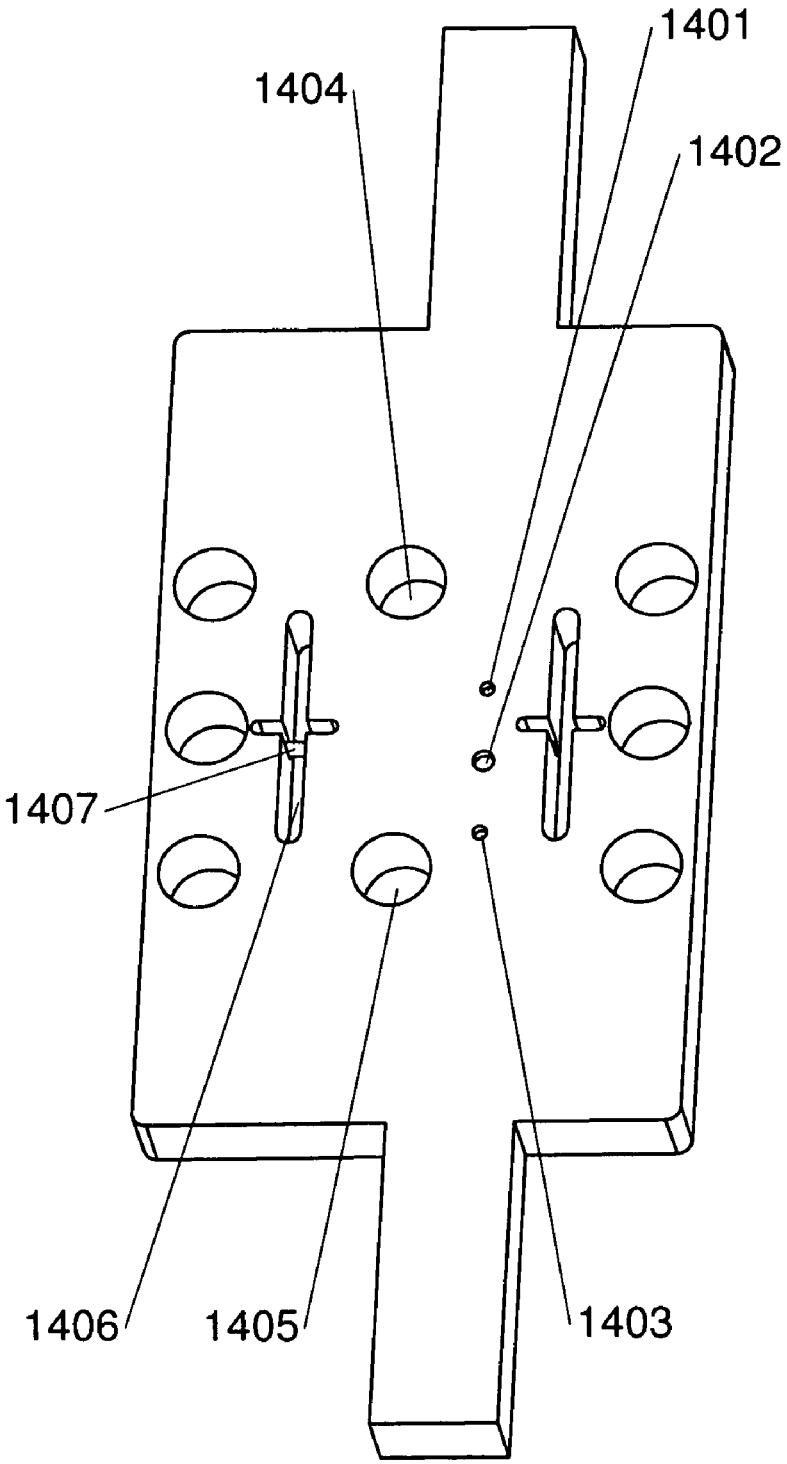

FIG. 14 is a perspective view of a movable piece of the apparatus.

Figure 15:
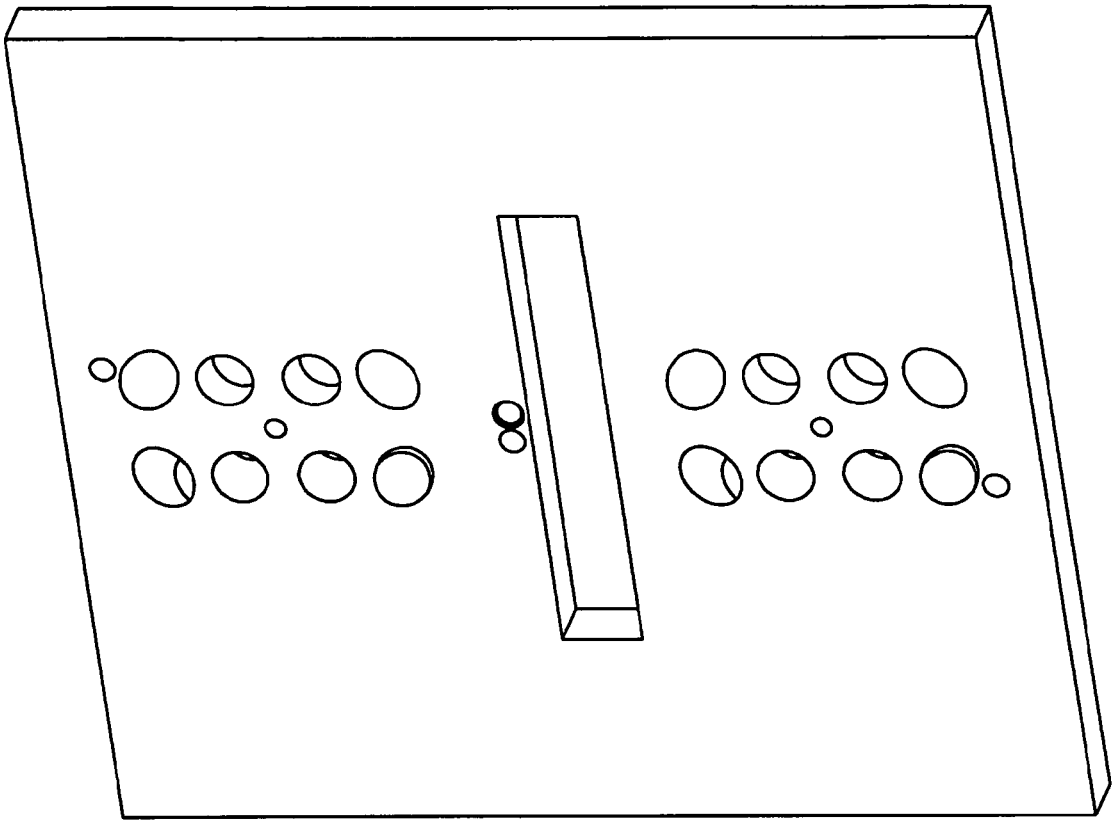

FIG. 15 is a perspective view of a stationary piece of the apparatus.

Figure 16:
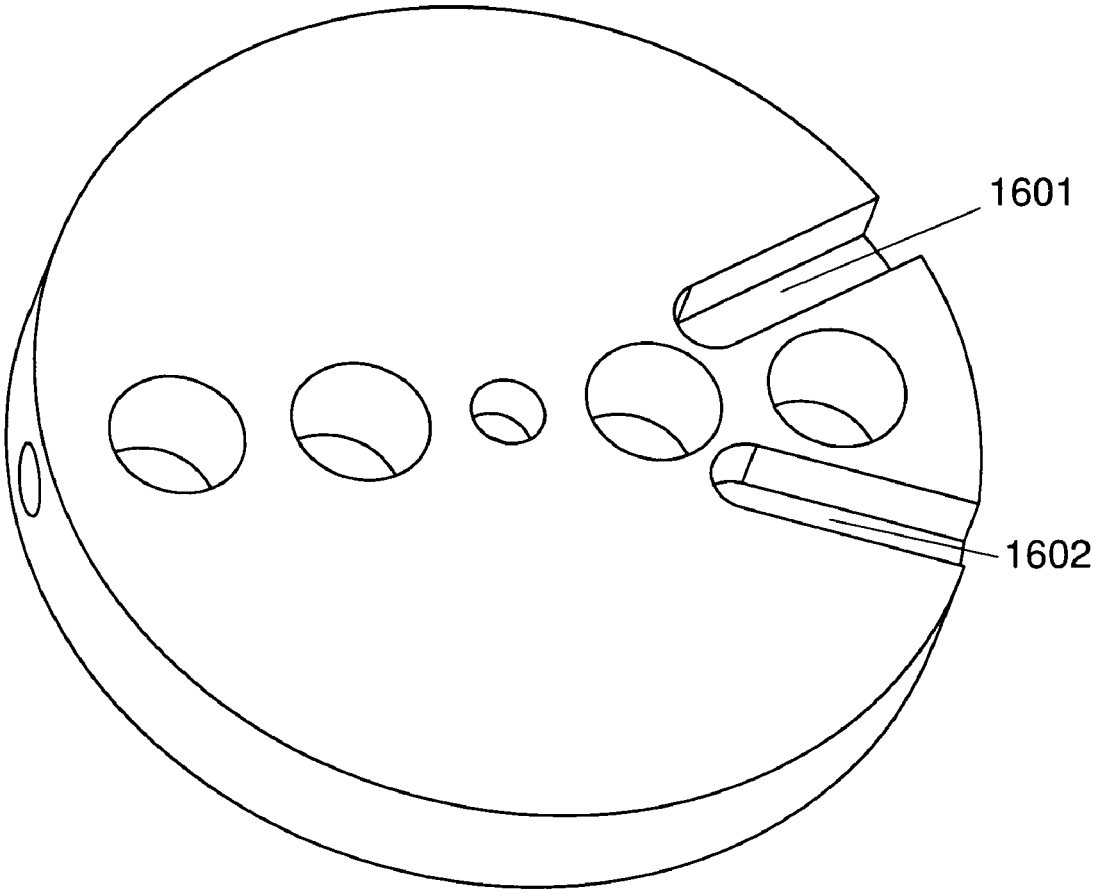

FIG. 16 is a perspective view of a movable piece of the apparatus.

Figure 17:
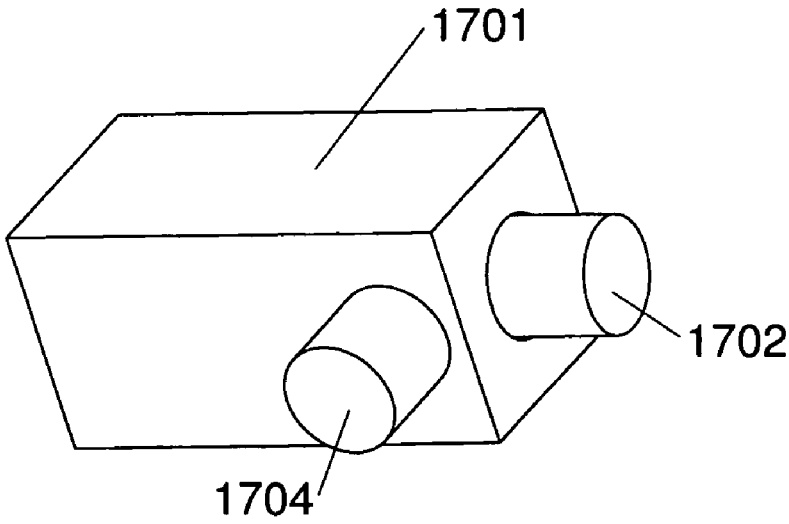

FIG. 17 is a perspective view of an internal assembly of the apparatus.

Figure 17A:
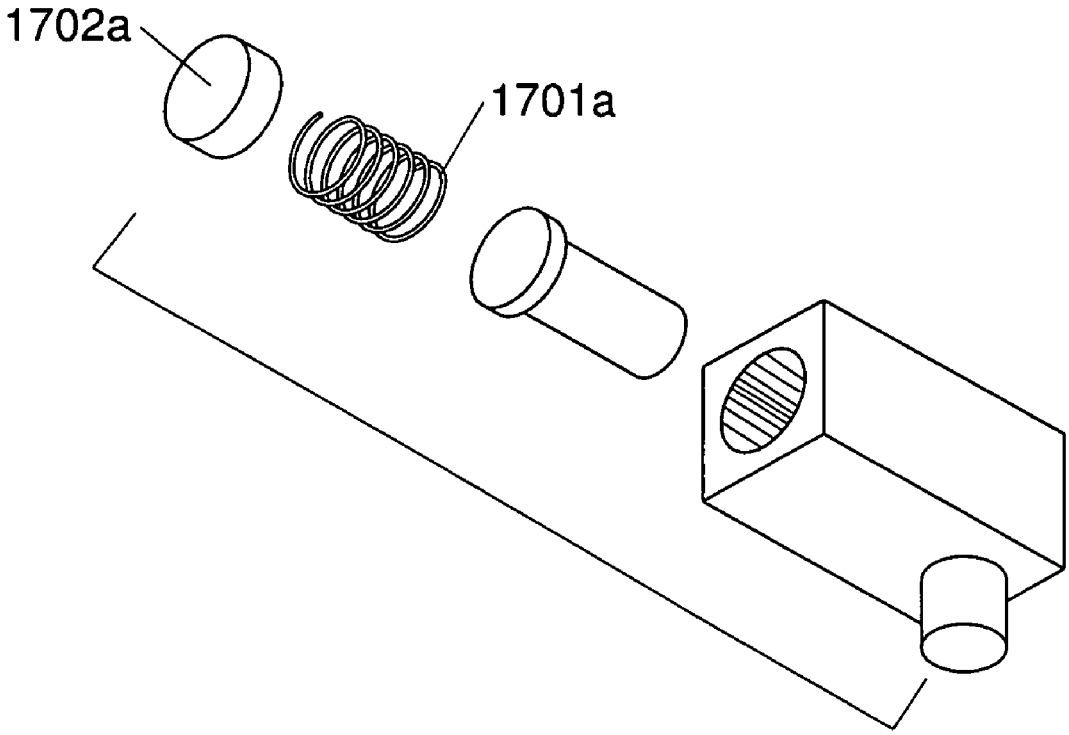

FIG. 17*a* is an exploded perspective view of the assembly depicted in FIG. 17.

Figure 18:
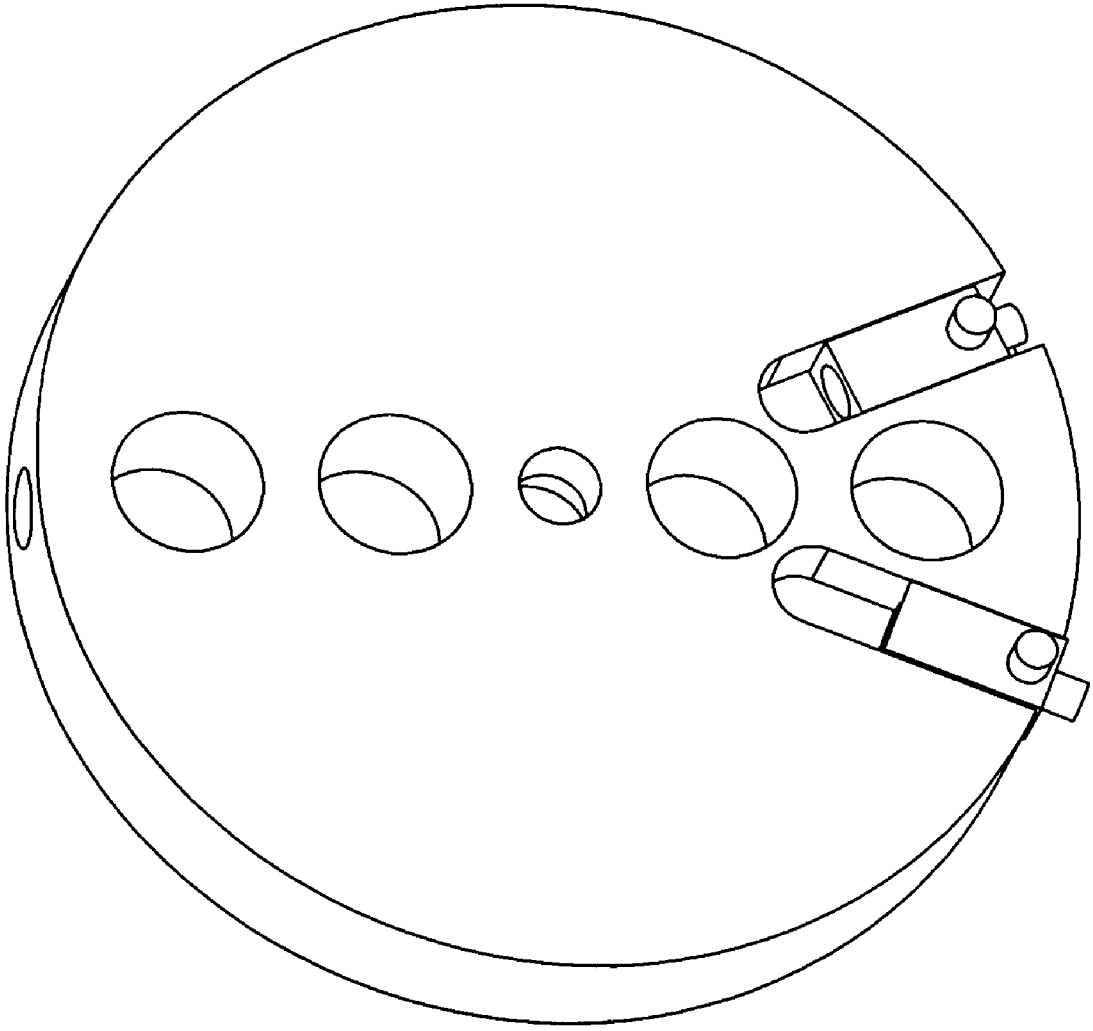

FIG. 18 is a perspective view of a moveable piece of the apparatus with internal assemblies assembled into that piece.

Figure 19:
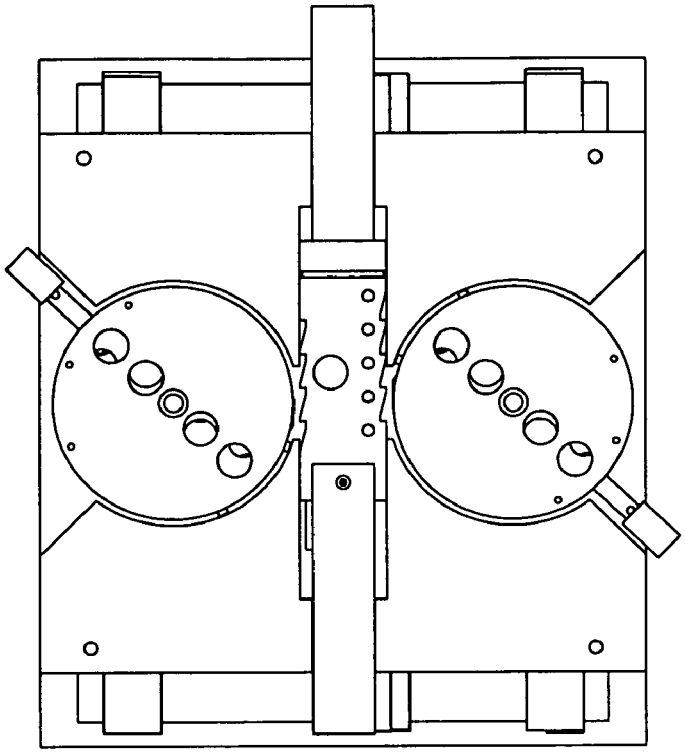

FIG. 19 is a top view of the apparatus with the top three layers removed showing specific positions of pieces on the fourth level.

Figure 19A:
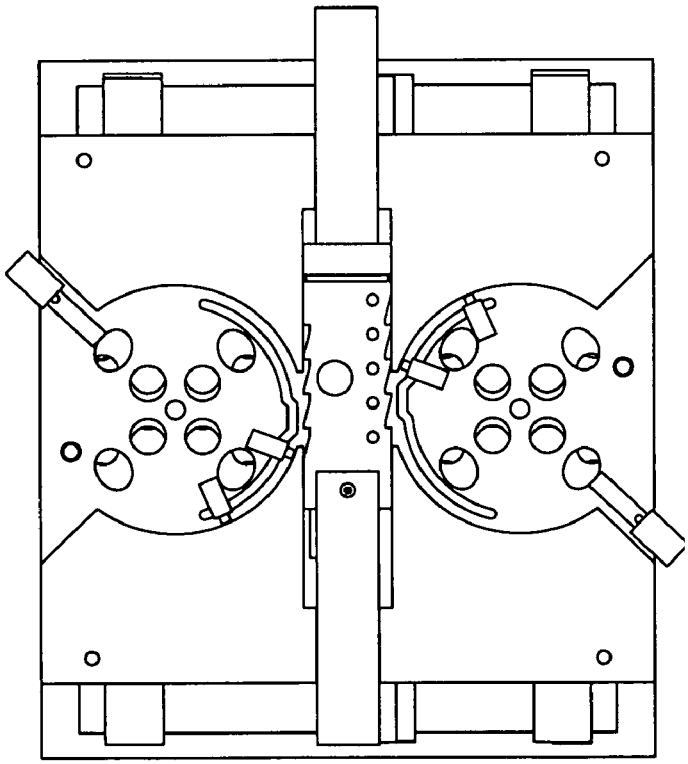

FIG. 19*a* is a close up view of the apparatus with the top three layers and two of the pieces on the fourth layer removed. This view shows specific positions of internal assemblies of the apparatus.

Figure 20:
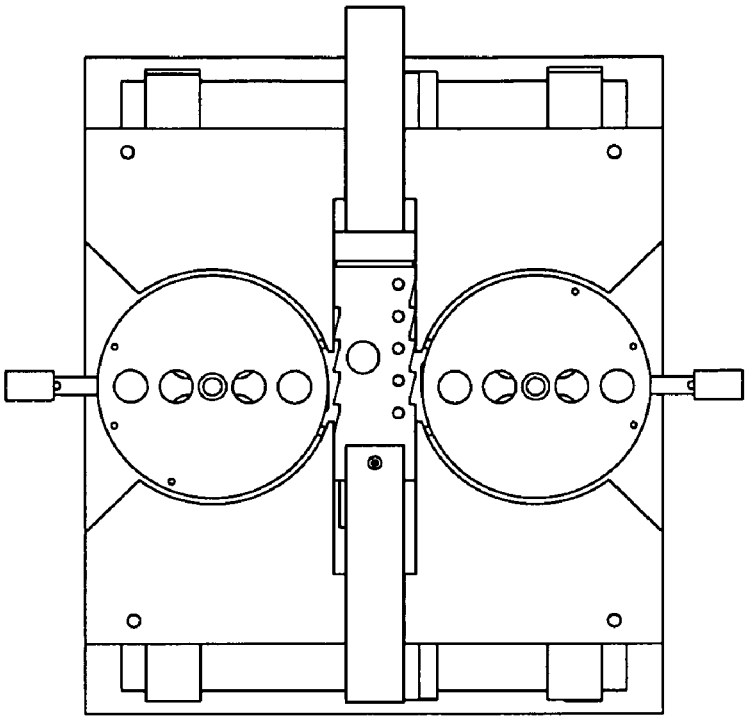

FIG. 20 is a top view of the apparatus with the top three layers removed showing specific positions of pieces on the fourth level.

Figure 20A:
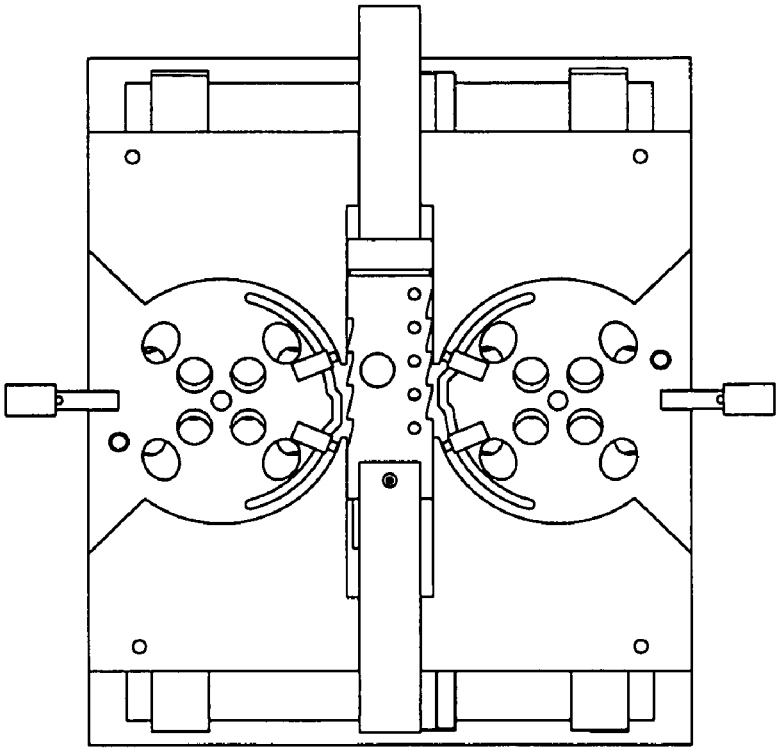

FIG. 20*a* is a close up view of the apparatus with the top three layers and two of the pieces on the fourth layer removed. This view shows specific positions of internal assemblies of the apparatus.

Figure 21:
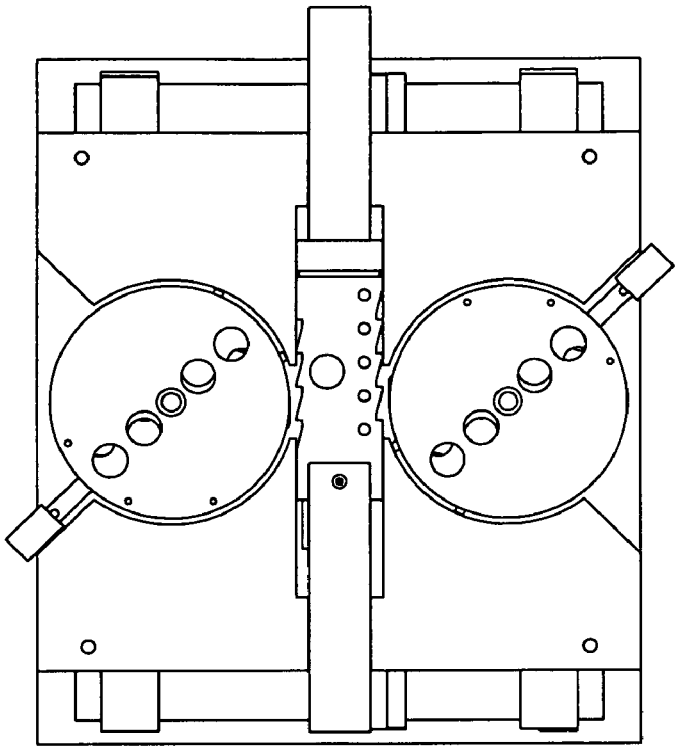

FIG. 21 is a top view of the apparatus with the top three layers removed showing specific positions of pieces on the fourth level.

Figure 21A:
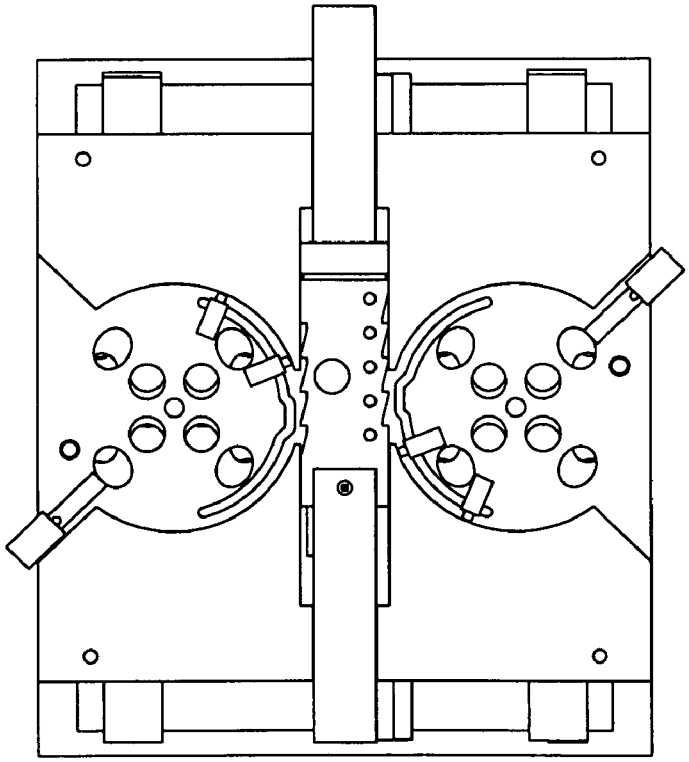

FIG. 21*a* is a close up view of the apparatus with the top three layers and two of the pieces on the fourth layer removed. This view shows specific positions of internal assemblies of the apparatus.

Figure 22:
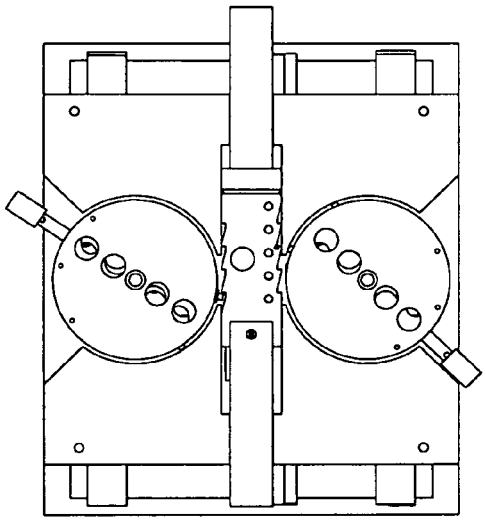

FIG. 22 is a top view of the apparatus with the top three layers removed showing the first in a sequence of movements of the pieces on the fourth layer.

Figure 22A:
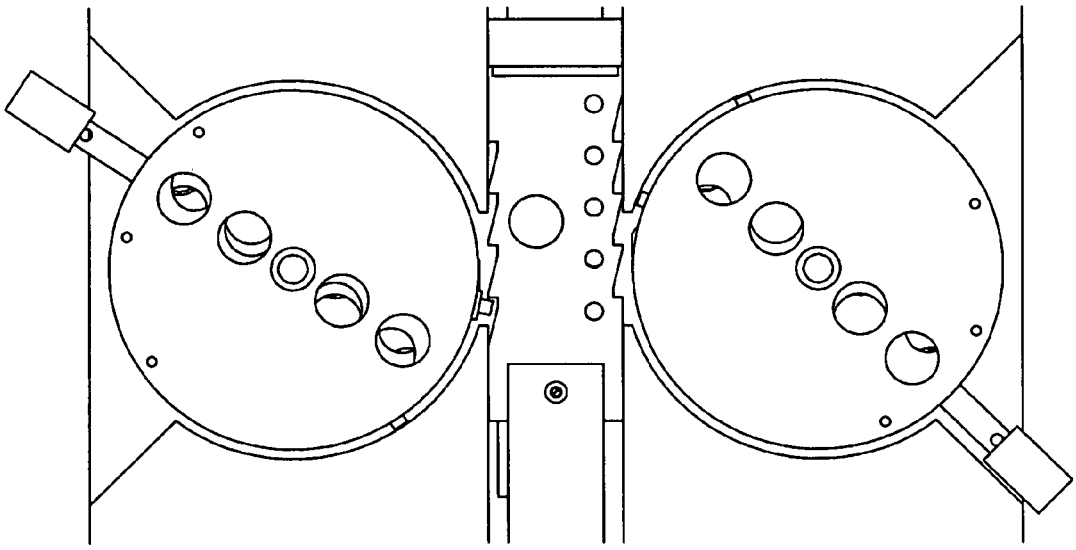

FIG. 22*a* is a close up of the same view in FIG. 22.

Figure 23:
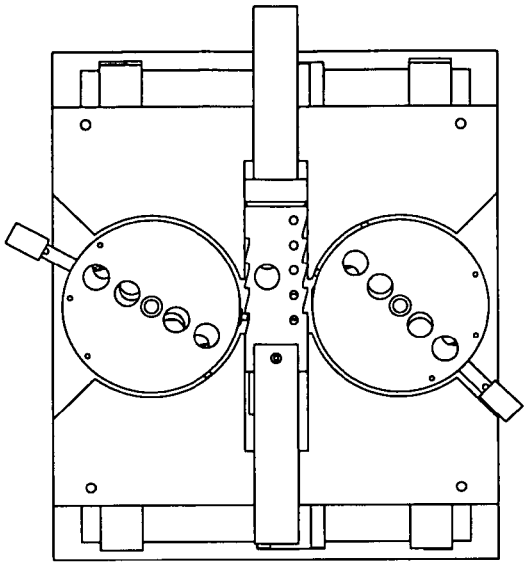

FIG. 23 is a top view of the apparatus with the top three layers removed showing the second position in a sequence of movements of the pieces on the fourth layer.

Figure 23A:
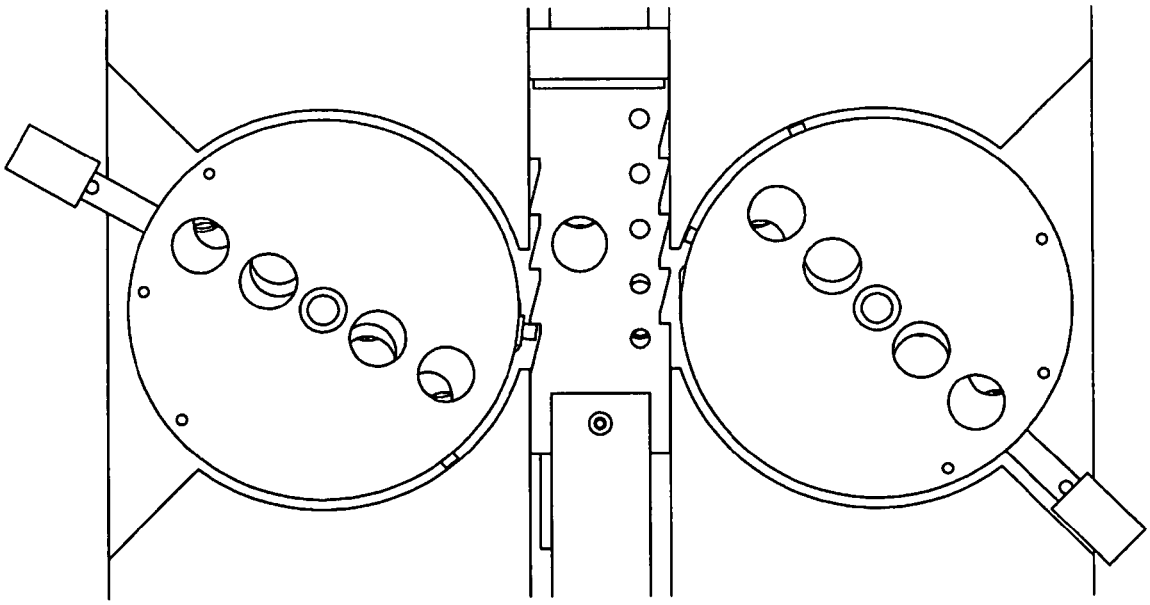

FIG. 23*a* is a close up of the same view in FIG. 23.

Figure 24:
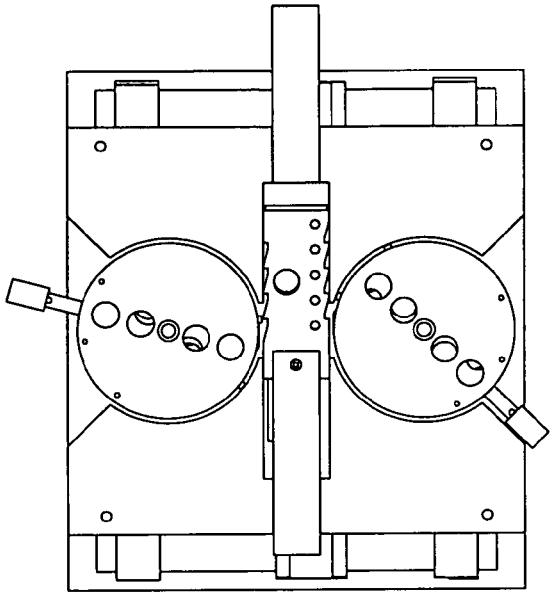

FIG. 24 is a top view of the apparatus with the top three layers removed showing the third position in a sequence of movements of the pieces on the fourth layer.

Figure 24A:
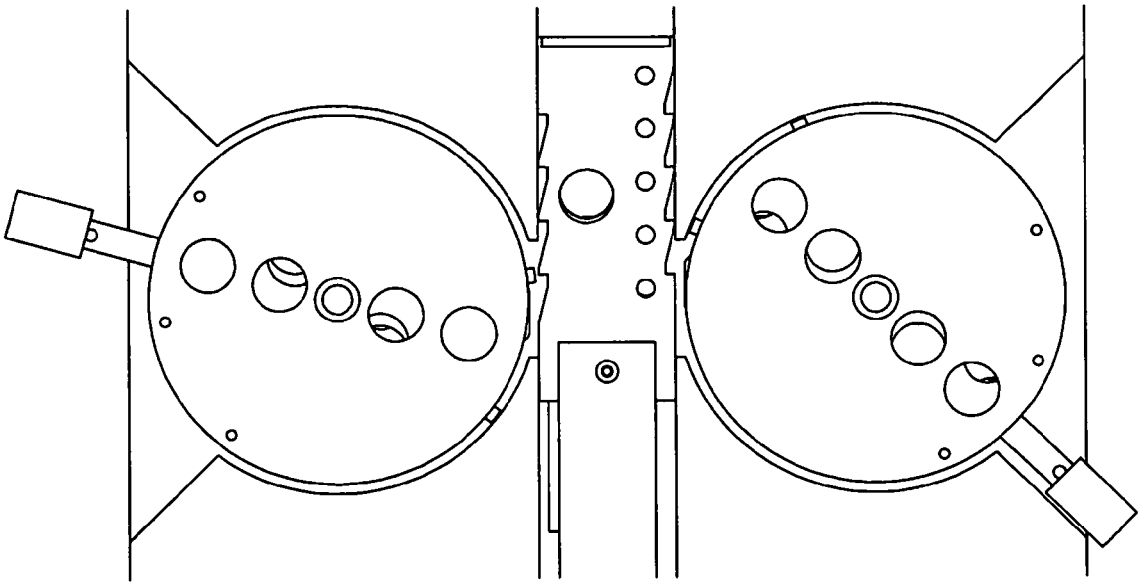

FIG. 24*a* is a close up of the same view in FIG. 24.

Figure 25:
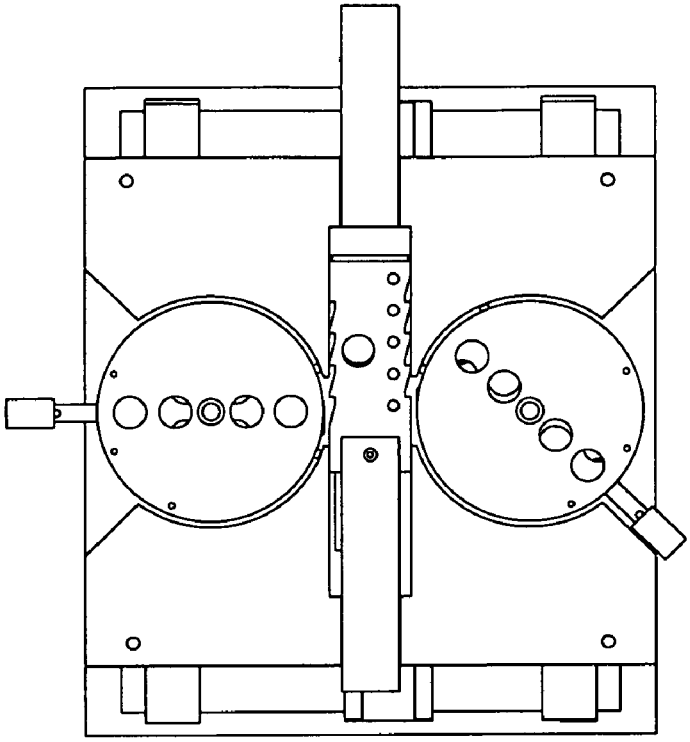

FIG. 25 is a top view of the apparatus with the top three layers removed showing the last position in a sequence of movements of the pieces on the fourth layer.

Figure 25A:
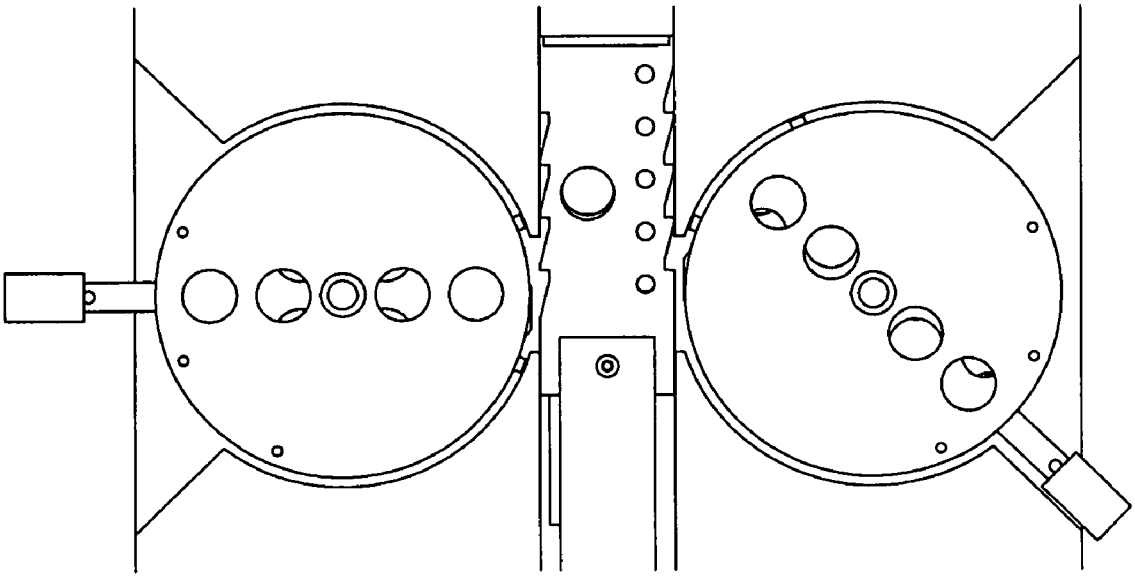

FIG. 25*a* is a close up of the same view in FIG. 25.

Figure 26:
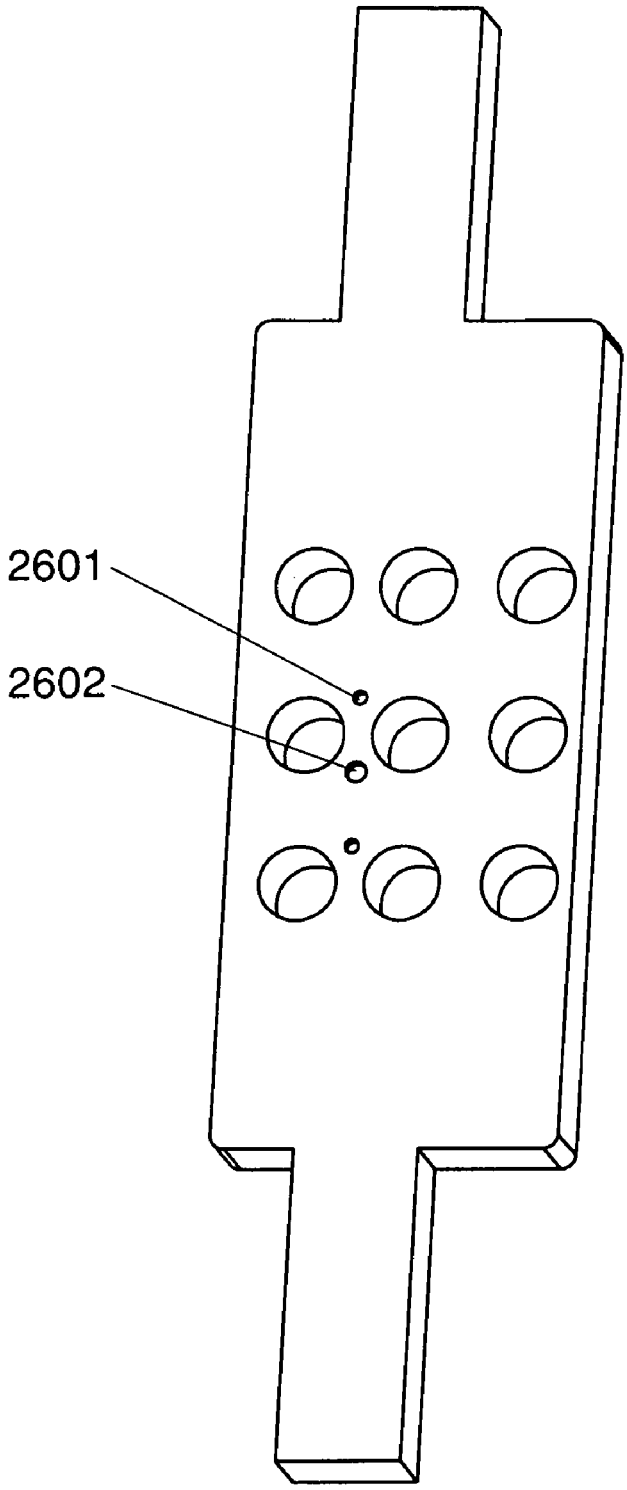

FIG. 26 is a perspective view of a movable piece of the apparatus.

Figure 27:
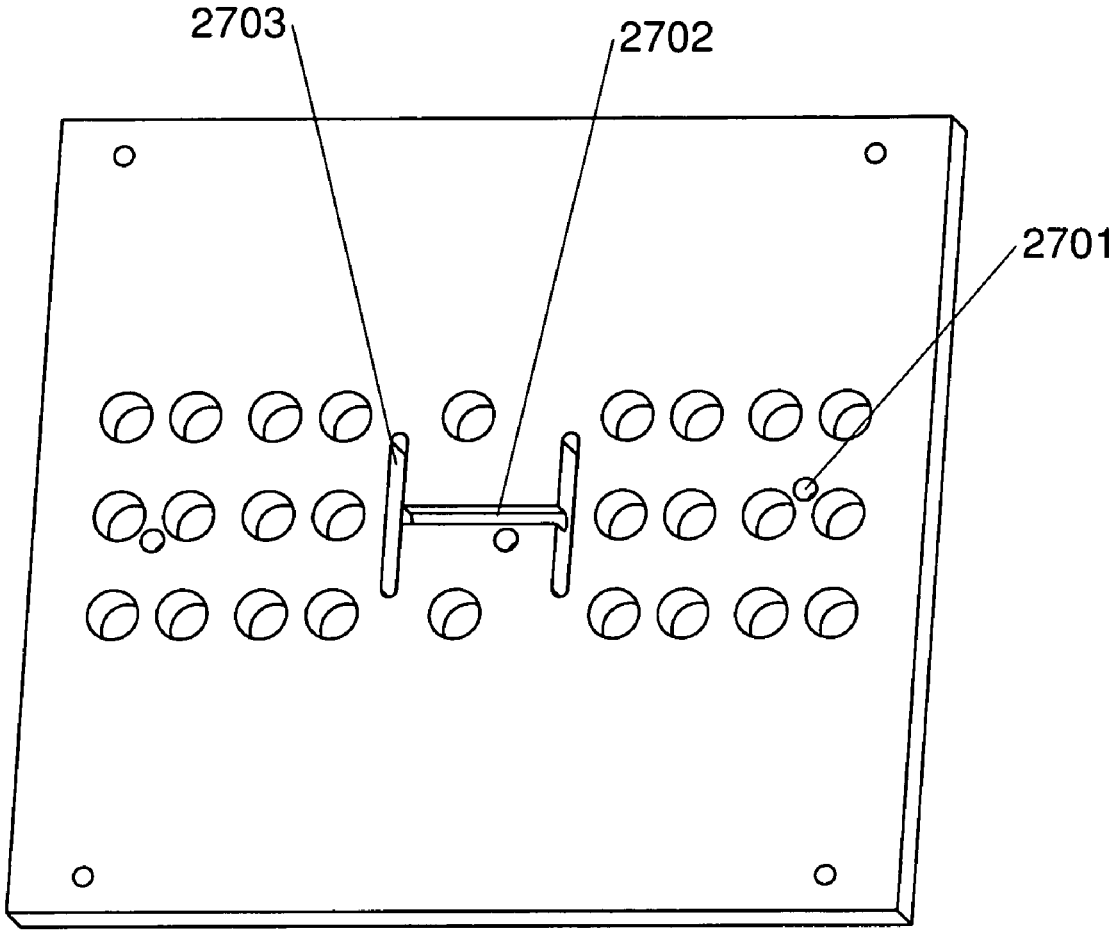

FIG. 27 is a perspective view of a stationary piece of the apparatus.

Figure 28:
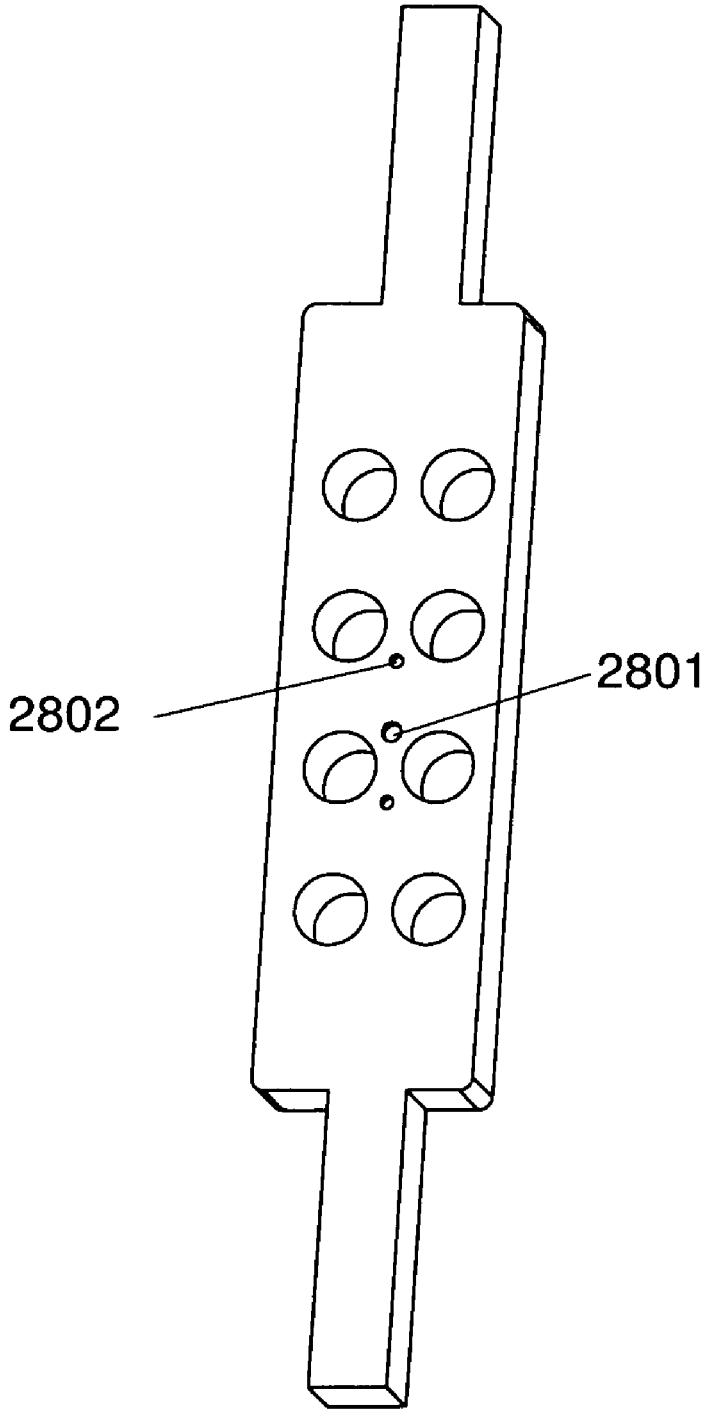

FIG. 28 is a perspective view of a movable piece of the apparatus.

Figure 29:
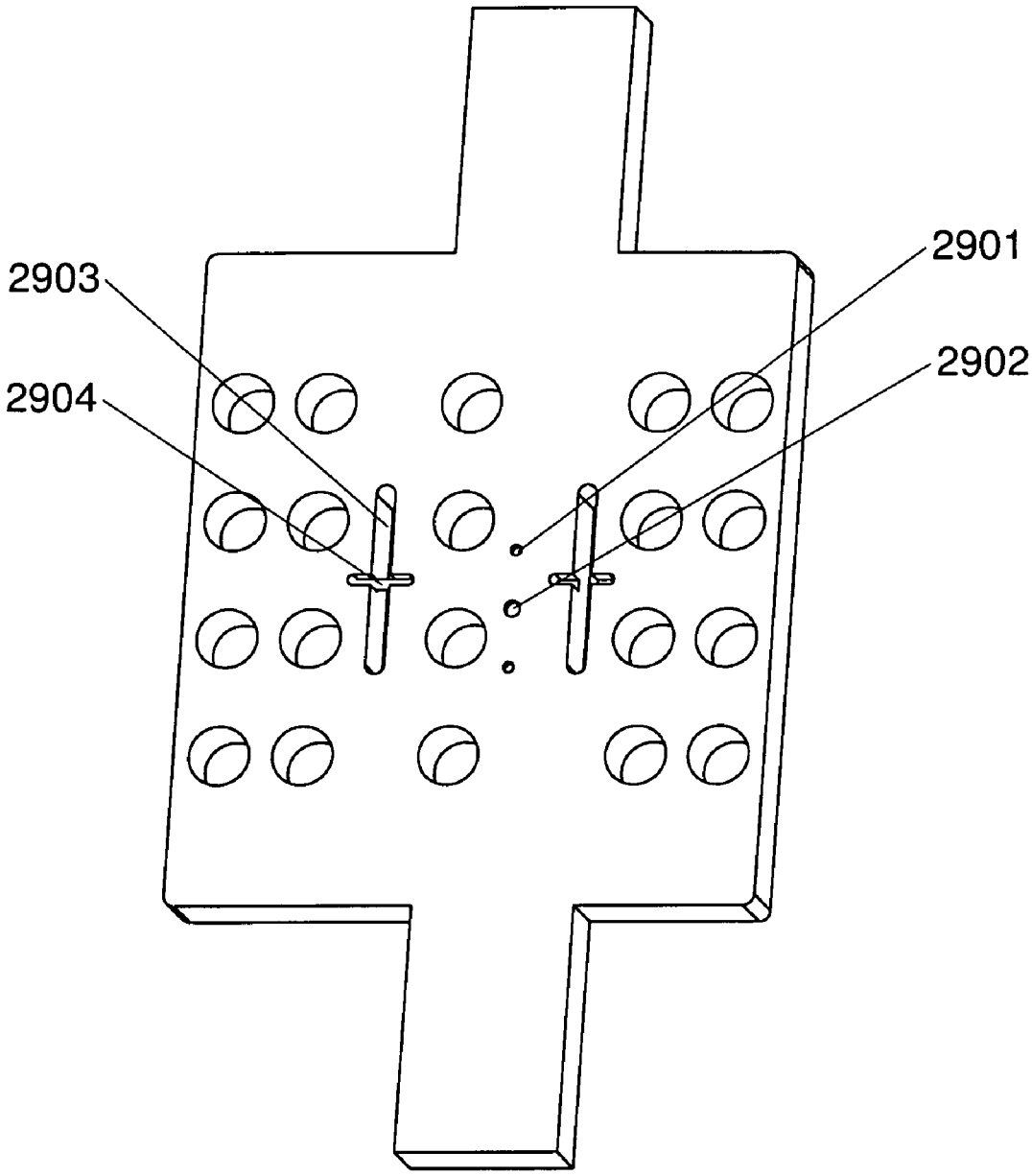

FIG. 29 is a perspective view of a movable piece of the apparatus.

Figure 30:
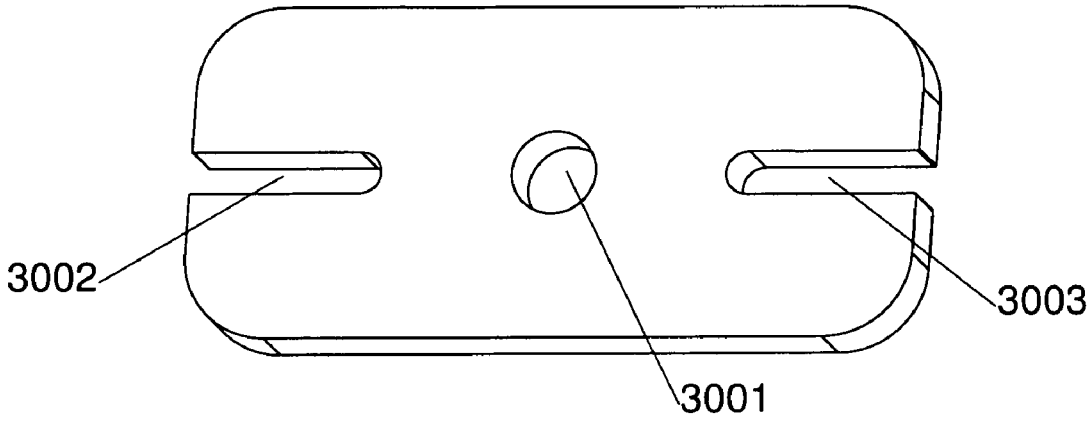

FIG. 30 is a perspective view of a linkage lever within of the apparatus.

Figure 31:
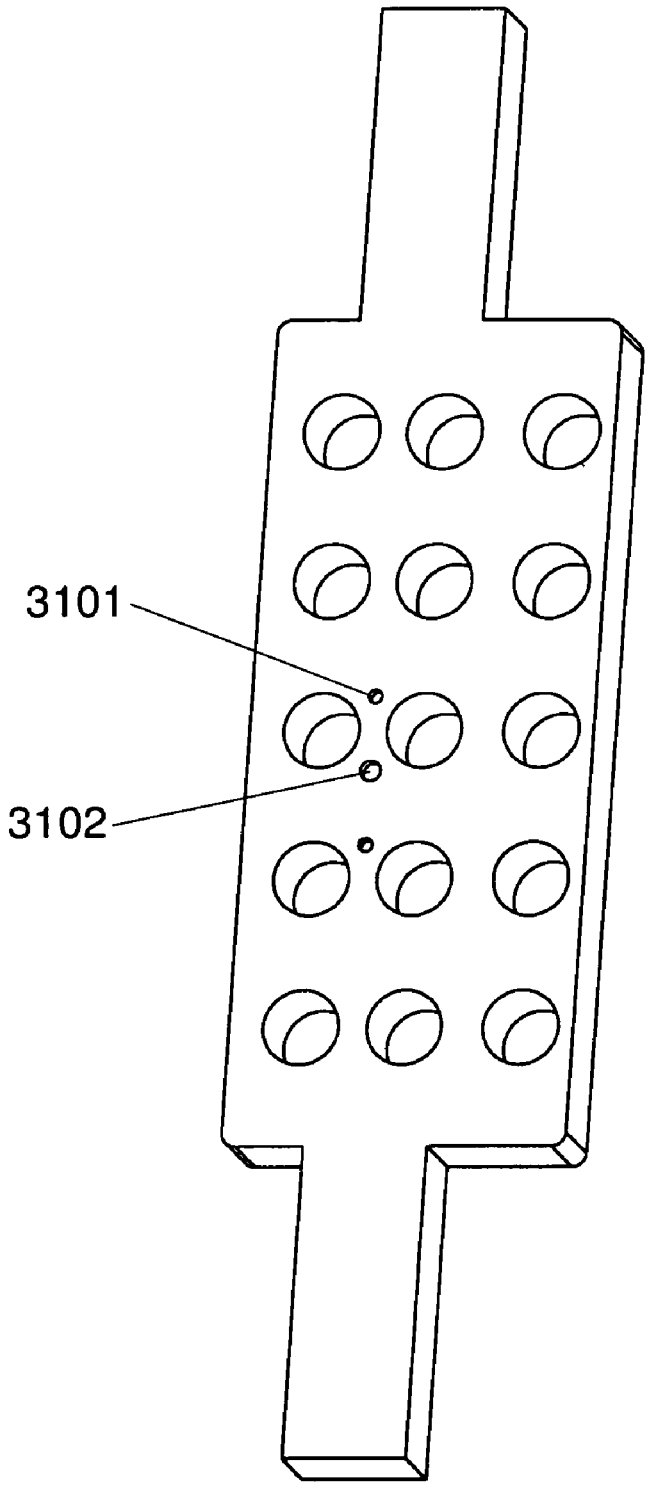

FIG. 31 is a perspective view of a movable piece of the apparatus

Figure 32:
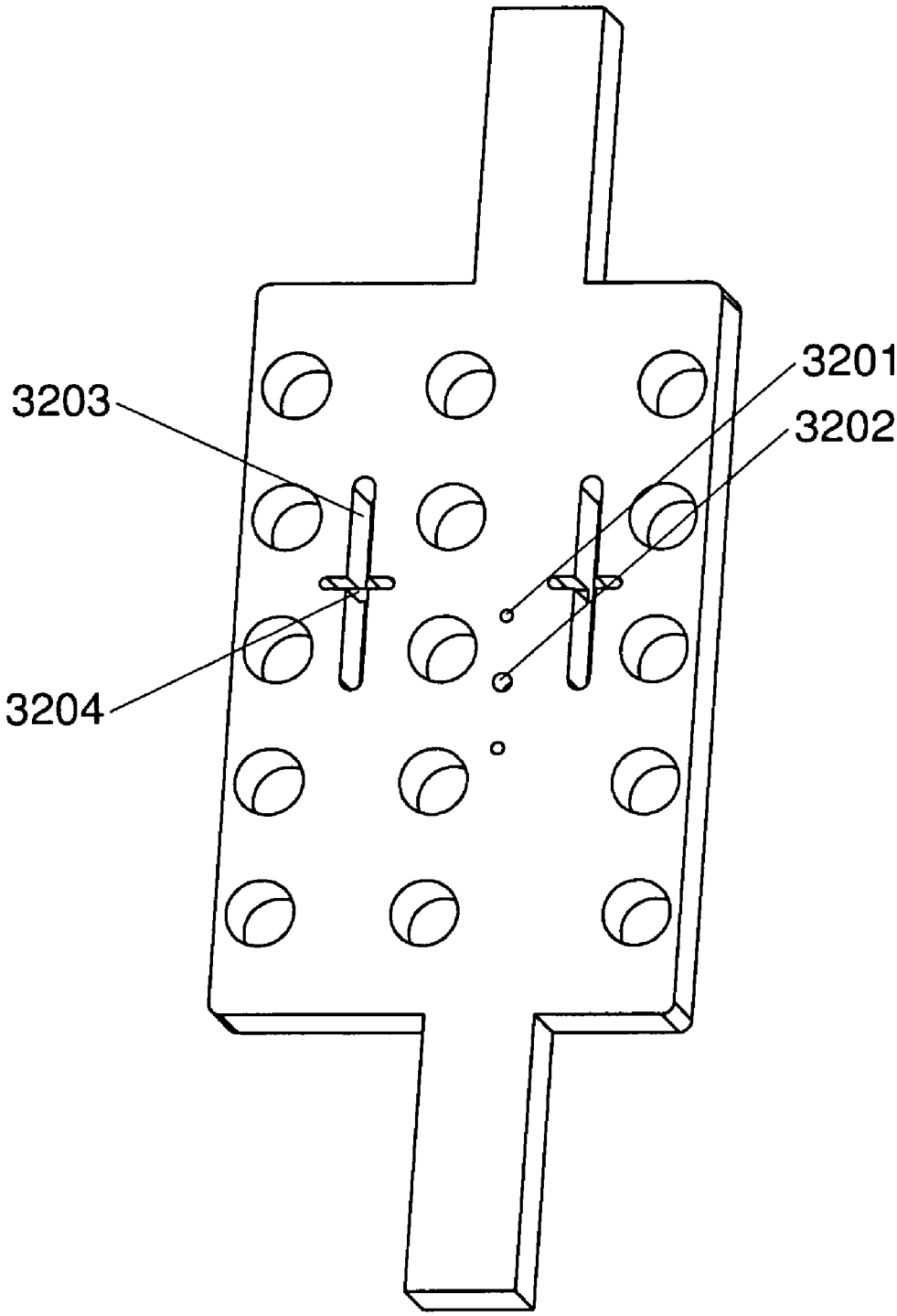

FIG. 32 is a perspective view of a movable piece of the apparatus

Figure 33:
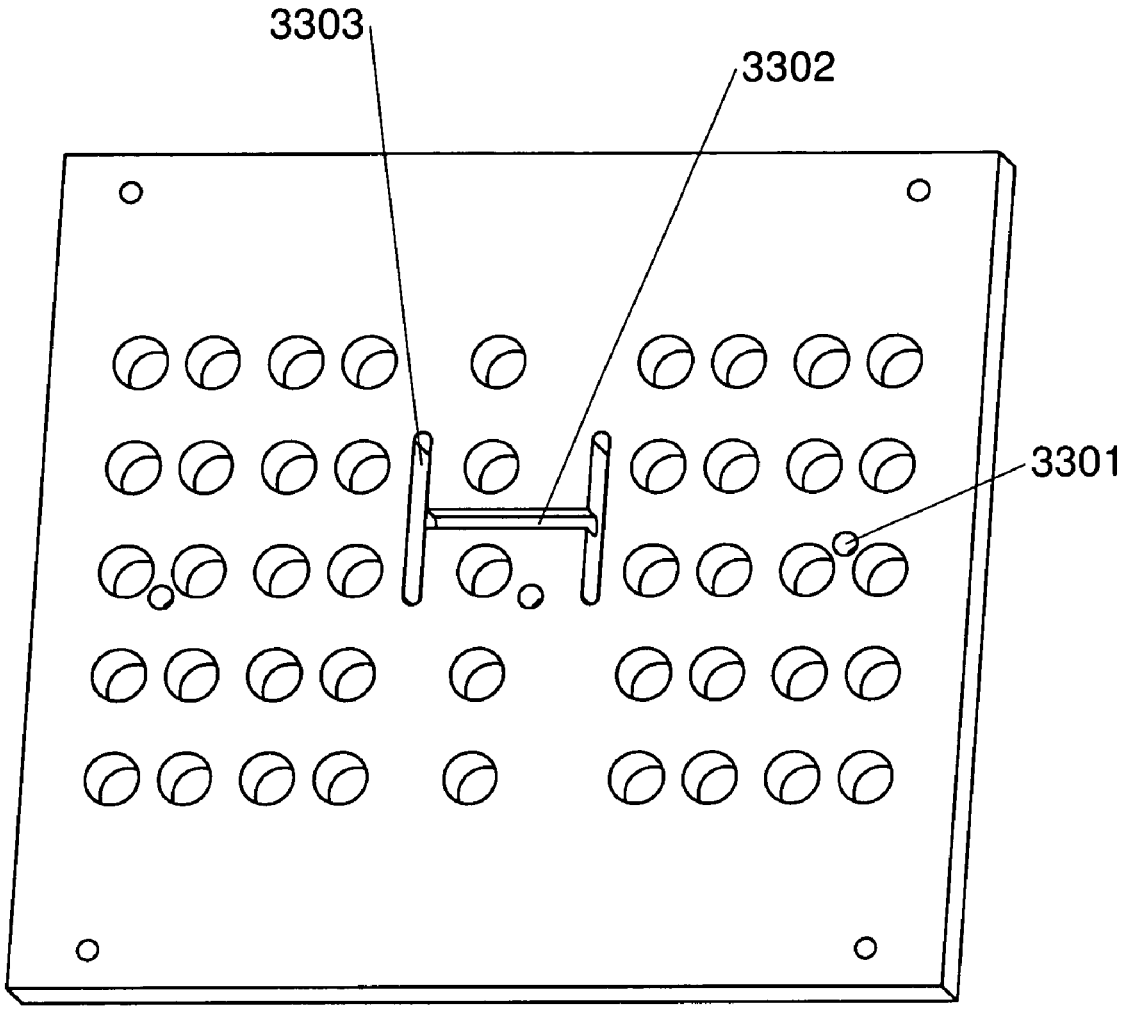

FIG. 33 is a perspective view of a stationary piece of the apparatus.

| DRAWINGS — Reference Numbers | |
|---|---|
| 201 | Left Game Start Frame Piece |
| 202 | Right Game Start Frame Piece |
| 203 | Game Start Piece |
| 204 | Pair Start Frame |
| 205 | passageways |
| 206 | Back Game Start Control Handle |
| 207 | Front Game Start Control Handle |
| 208 | passageways |
| 209 | passageway |
| 210 | passageways |
| 211 | Spring Block |
| 212 | pin |
| 213 | Pair Start Assembly |
| 214 | Pair Start Assembly |
| 215 | Pair Start Assembly |
| 216 | Pair Start Assembly |
| 217 | Pair Start Static Frame |
| 218 | passageways |
| 219 | vertical holes |
| 220 | ball plunger |
| 221 | ball plunger |
| 222 | ball plunger |
| 223 | Game Object |
| 224 | Game Object |
| 225 | Game Object |
| 226 | Game Object |
| 227 | Game Object |
| 228 | Game Object |
| 229 | Game Object |
| 230 | Game Object |
| 231 | Game Object |
| 301 | Front Rotary Frame Piece |
| 302 | Back Rotary Frame Piece |
| 303 | Cam Frame Piece |
| 304 | Left Rotary Puck |
| 305 | Right Rotary Puck |
| 306 | handle |
| 307 | handle |
| 308 | hole |
| 309 | hole |
| 310 | hole |
| 311 | hole |
| 312 | passageways |
| 313 | passageways |
| 314 | Ratchet Puck |
| 315 | handle |
| 316 | handle |
| 317 | passageway |
| 318 | hole |
| 319 | Spring Pin Assembly |
| 320 | Spring Pin Assembly |
| 321 | Spring Pin Assembly |
| 322 | Spring Pin Assembly |
| 323 | Axle |
| 324 | Axle |
| 325 | ball plunger |
| 326 | ball plunger |
| 327 | ball plunger |
| 401 | Odd Game Object Puck |
| 403 | Three Hole Frame Piece |
| 404 | Three Hole Frame Piece |
| 405 | Three Hole Frame Piece |
| 406 | Three Hole Frame Piece |
| 407 | Three Hole Frame Piece |
| 408 | Three Hole Frame Piece |
| 409 | Left 3x3 Puck |
| 410 | Right 3x3 Puck |
| 411 | passageways |
| 412 | Linkage Lever |
| 413 | passageways |
| 414 | passageways |
| 415 | passageways |

-continued

| DRAWINGS — Reference Numbers | |
|---|---|
| 416 | axle |
| 417 | Three Hole Static Frame |
| 418 | handles |
| 419 | handles |
| 420 | handles |
| 421 | ball plunger |
| 422 | ball plunger |
| 423 | ball plunger |
| 424 | Upper Four Hole Frame Piece |
| 425 | Upper Four Hole Frame Piece |
| 426 | Upper Four Hole Frame Piece |
| 427 | Upper Four Hole Frame Piece |
| 428 | Upper Four Hole Frame Piece |
| 429 | Upper Four Hole Frame Piece |
| 430 | Left Upper 4x2 Puck |
| 431 | Upper 4x5 Puck |
| 432 | Right Upper 4x2 Puck |
| 433 | handles |
| 434 | handles |
| 435 | handles |
| 436 | Upper Four Hole Static Frame |
| 437 | passageway |
| 438 | passageway |
| 439 | passageway |
| 440 | passageway |
| 441 | ball plunger |
| 442 | ball plunger |
| 443 | ball plunger |
| 444 | vertical holes |
| 501 | Five Hole Frame Piece |
| 502 | Five Hole Frame Piece |
| 503 | Five Hole Frame Piece |
| 504 | Five Hole Frame Piece |
| 505 | Five Hole Frame Piece |
| 506 | Five Hole Frame Piece |
| 507 | Five Hole Static Frame |
| 508 | Left 5x3 Puck |
| 509 | Center 5x3 Puck |
| 510 | Right 5x3 Puck |
| 511 | handles |
| 512 | handles |
| 513 | handles |
| 514 | passageways |
| 515 | passageways |
| 516 | passageways |
| 517 | passageways |
| 518 | ball plunger |
| 519 | ball plunger |
| 520 | ball plunger |
| 521 | Lower Four Hole Frame Piece |
| 522 | Lower Four Hole Frame Piece |
| 523 | Lower Four Hole Frame Piece |
| 524 | Lower Four Hole Frame Piece |
| 525 | Lower Four Hole Frame Piece |
| 526 | Lower Four Hole Frame Piece |
| 527 | Left Lower 4x2 Puck |
| 528 | Lower 4x5 Puck |
| 529 | Right Lower 4x2 Puck |
| 530 | handles |
| 531 | handles |
| 532 | handles |
| 533 | passageways |
| 534 | passageways |
| 535 | passageways |
| 536 | Lower Four Hole Static Frame |
| 537 | passageways |
| 538 | Linkage Lever |
| 539 | axle |
| 601 | Collection tray |
| 602 | divider |
| 603 | inclined panel |
| 604 | inclined panel |
| 701 | Top Side |
| 702 | Right Side |
| 703 | Near Side |
| 701a | Bottom Side |
| 702a | Left Side |

-continued

| DRAWINGS — Reference Numbers | |
|---|---|
| 703a | Far Side |
| 801 | cavity |
| 802 | cavities |
| 901 | handles |
| 902 | cross bar |
| 903 | sliding body |
| 904 | sliding body |
| 905 | hole |
| 1101 | body |
| 1102 | spring |
| 1103 | ball |
| 1104 | ridge |
| 1201 | hole |
| 1202 | hole |
| 1203 | cavity |
| 1204 | channel |
| 1205 | channel |
| 1206 | semicircular channel section |
| 1207 | semicircular channel section |
| 1208 | semicircular channel section |
| 1209 | semicircular channel section |
| 1210 | deviating channel section |
| 1211 | deviating channel section |
| 1212 | vertical holes |
| 1221 | passageway |
| 1222 | passageway |
| 1223 | passageway |
| 1224 | passageway |
| 1231 | passageway |
| 1232 | passageway |
| 1233 | passageway |
| 1234 | passageway |
| 1241 | passageway |
| 1242 | passageway |
| 1243 | passageway |
| 1244 | passageway |
| 1251 | passageway |
| 1252 | passageway |
| 1253 | passageway |
| 1254 | passageway |
| 1301 | flat surface at an acute angle |
| 1302 | flat surface |
| 1303 | lower level of Ratchet Puck 314 |
| 1401 | hole |
| 1402 | hole |
| 1403 | hole |
| 1404 | passageway |
| 1405 | passageway |
| 1406 | slot |
| 1407 | pin |
| 1601 | channel |
| 1602 | channel |
| 1701 | body |
| 1702 | pin |
| 1704 | pin |
| 1701a | compression spring |
| 1702a | plug |
| 2601 | holes |
| 2602 | holes |
| 2701 | vertical holes |
| 2702 | channel |
| 2703 | slot |
| 2801 | holes |
| 2802 | holes |
| 2901 | holes |
| 2902 | hole |
| 2903 | slots |
| 2904 | pins |
| 3001 | hole |
| 3002 | slot |
| 3003 | slot |
| 3101 | holes |
| 3102 | holes |
| 3201 | holes |
| 3202 | hole |
| 3203 | slot |
| 3204 | pin |

-continued

| DRAWINGS — Reference Numbers | |
|---|---|
| 3301 | vertical holes |
| 3302 | channel |
| 3303 | slot |

DETAILED DESCRIPTION

Introduction

An embodiment is presented here consisting of a stack of layers. The layers comprise a game apparatus. The material used to form the parts of the game apparatus need only be rigid and strong enough to perform the functions described in the following. The material may be transparent, translucent, or opaque.

In the figures depicting the embodiment specific items and features are indicated by reference numbers. Each reference number has two numerical digits indicating the specific item or feature in a figure. One or two numerical digits indicating the specific figure where the item or feature is referenced precede these digits. The digits indicating the specific item or feature in a figure may or may not be followed by a letter.

Figure 1:
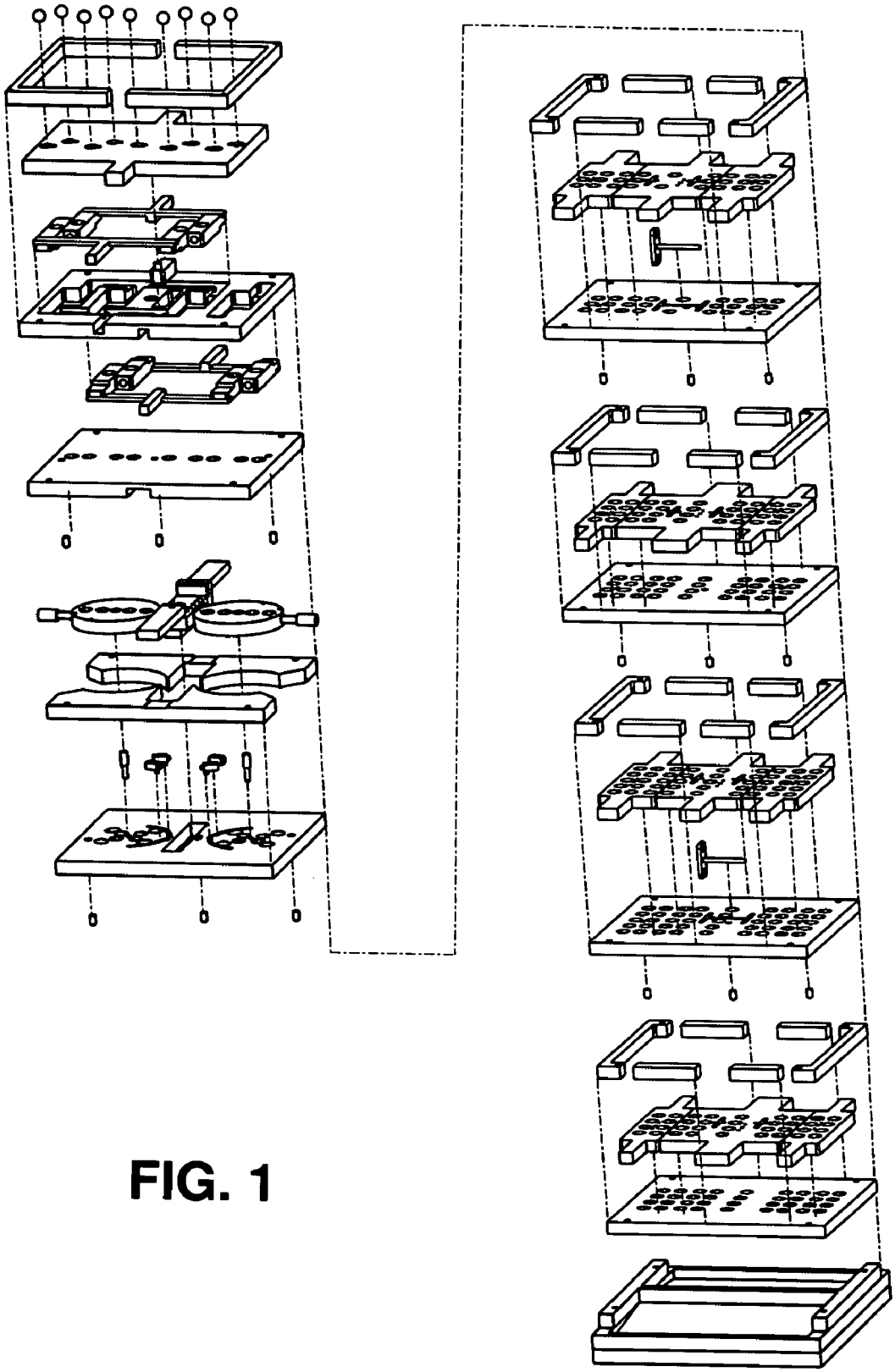
FIG. 1 is an exploded perspective view of the entire apparatus.
Figure 2:
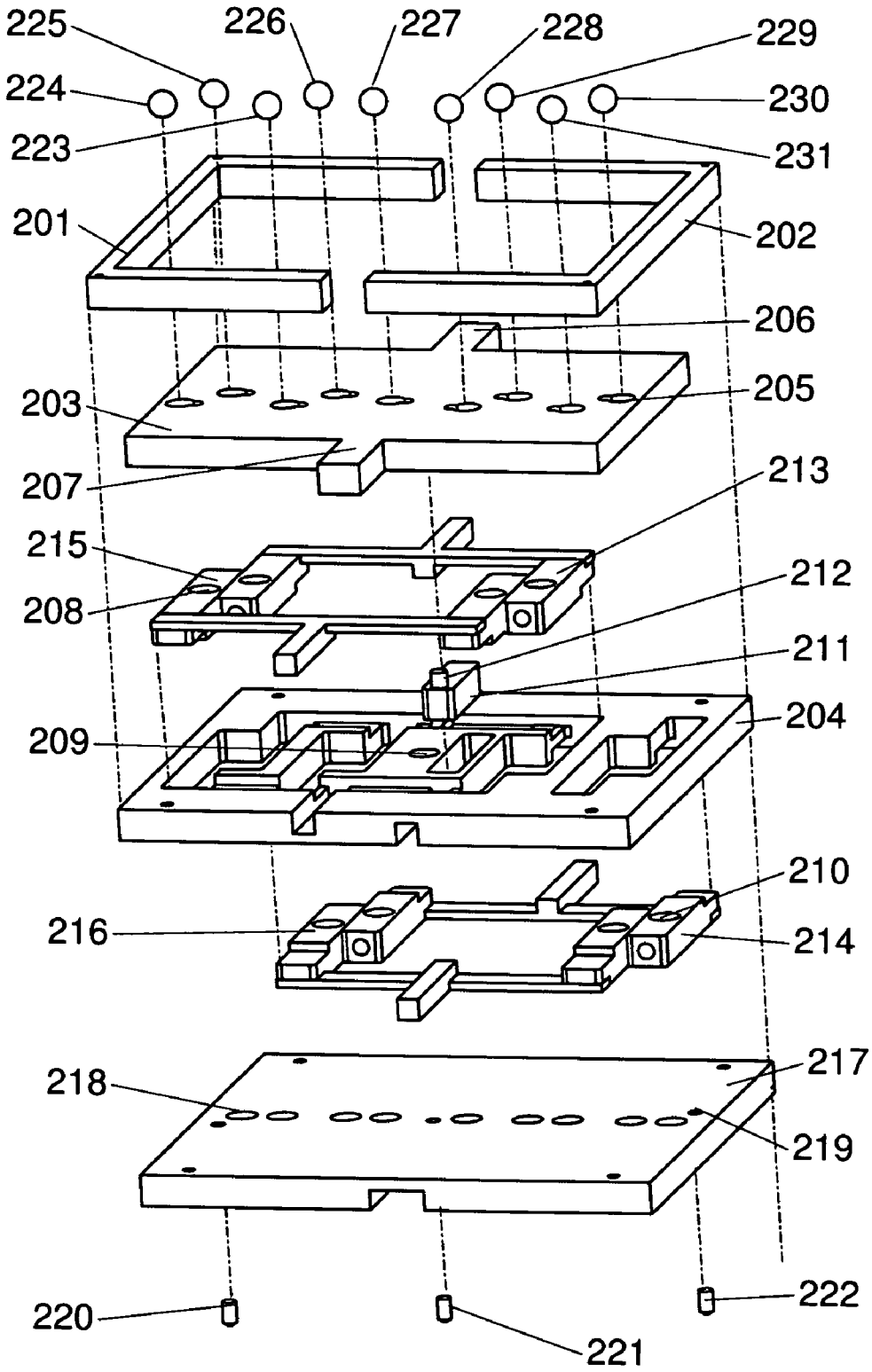
FIG. 2 is an exploded perspective view of the first, second, and third layers of the apparatus.
Figure 3:
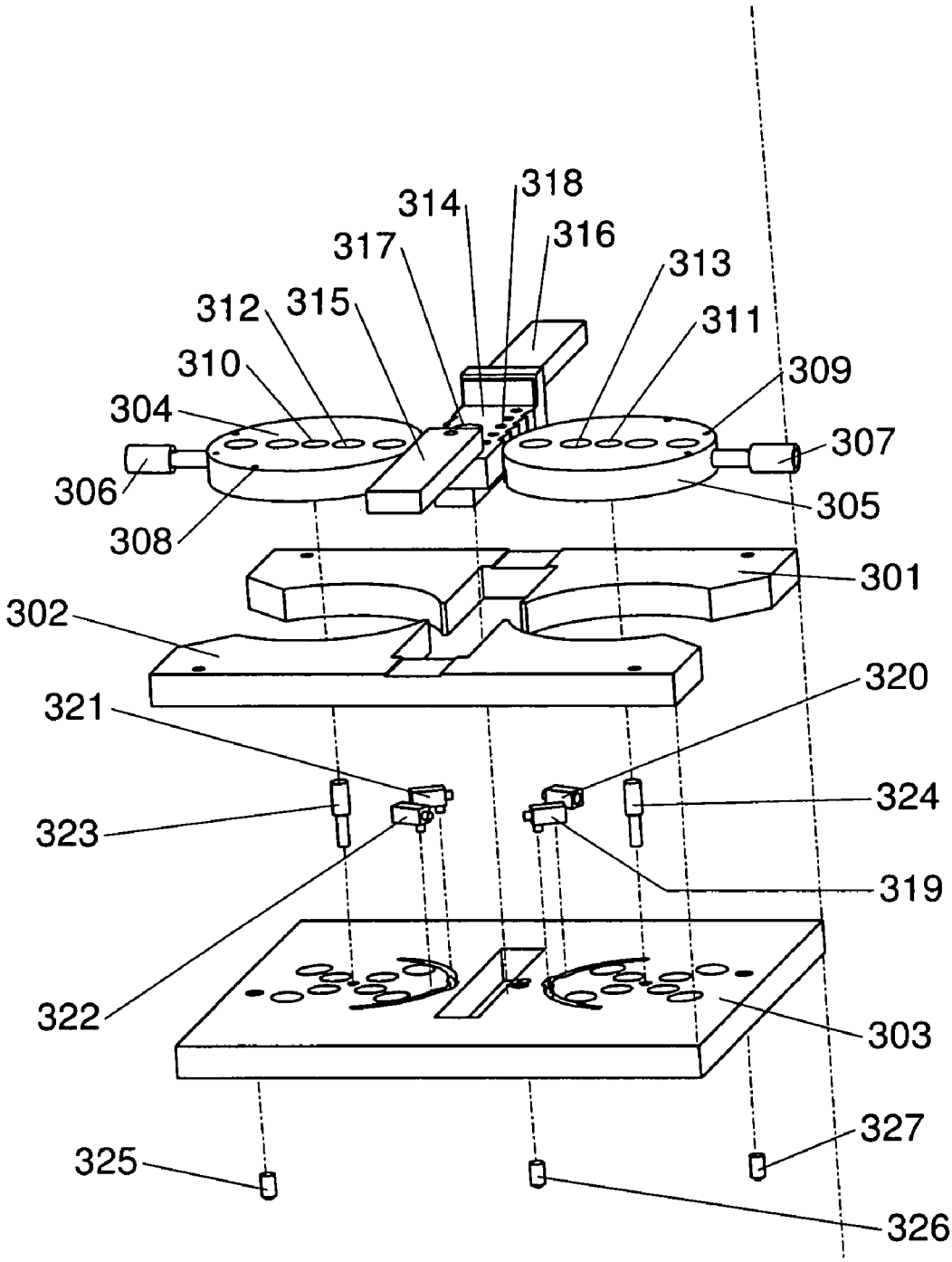
FIG. 3 is an exploded perspective view of the fourth and fifth layers of the apparatus.
Figure 4:
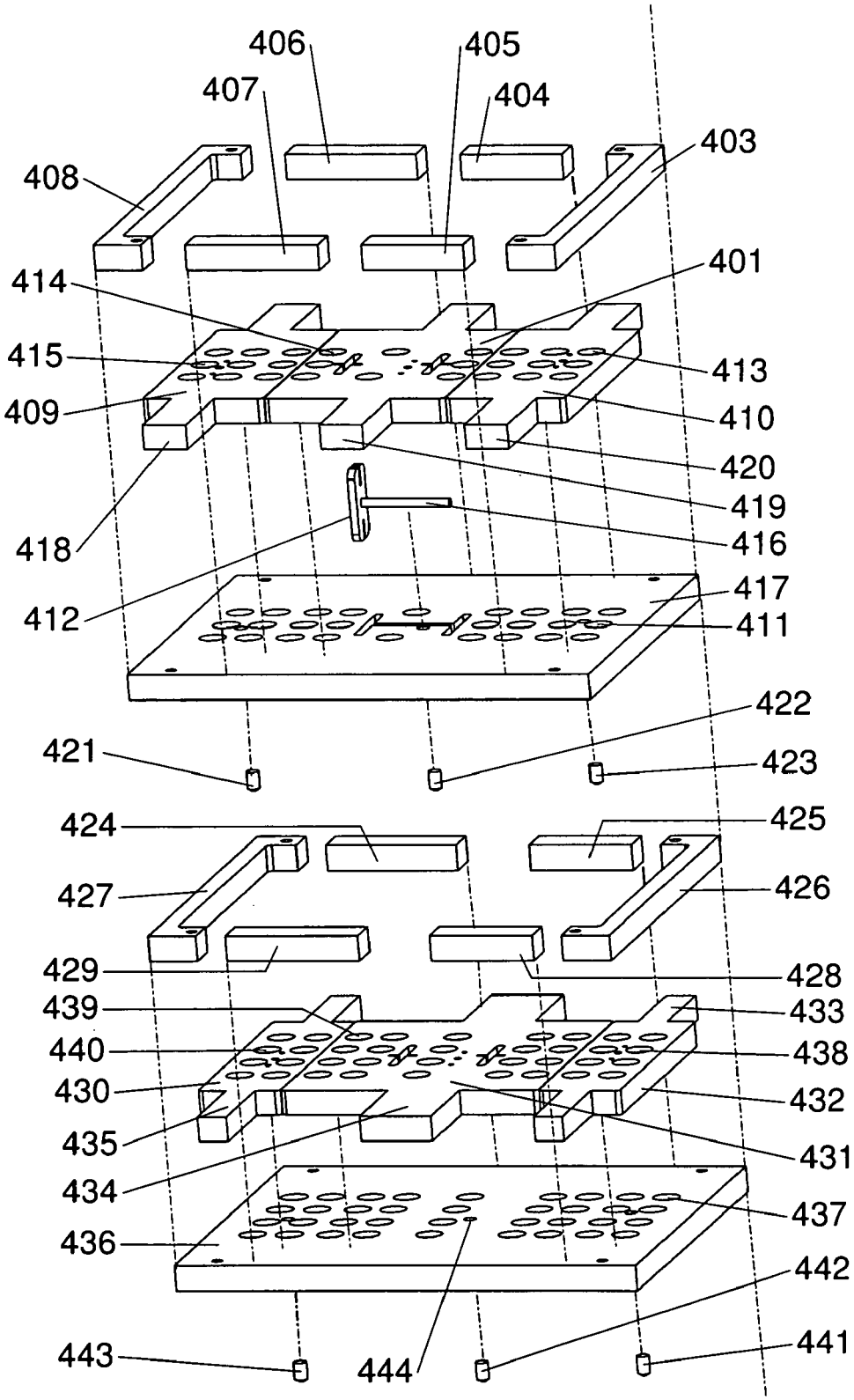
FIG. 4 is an exploded perspective view of the sixth, seventh, eighth, and ninth layers of the apparatus.
Figure 5:
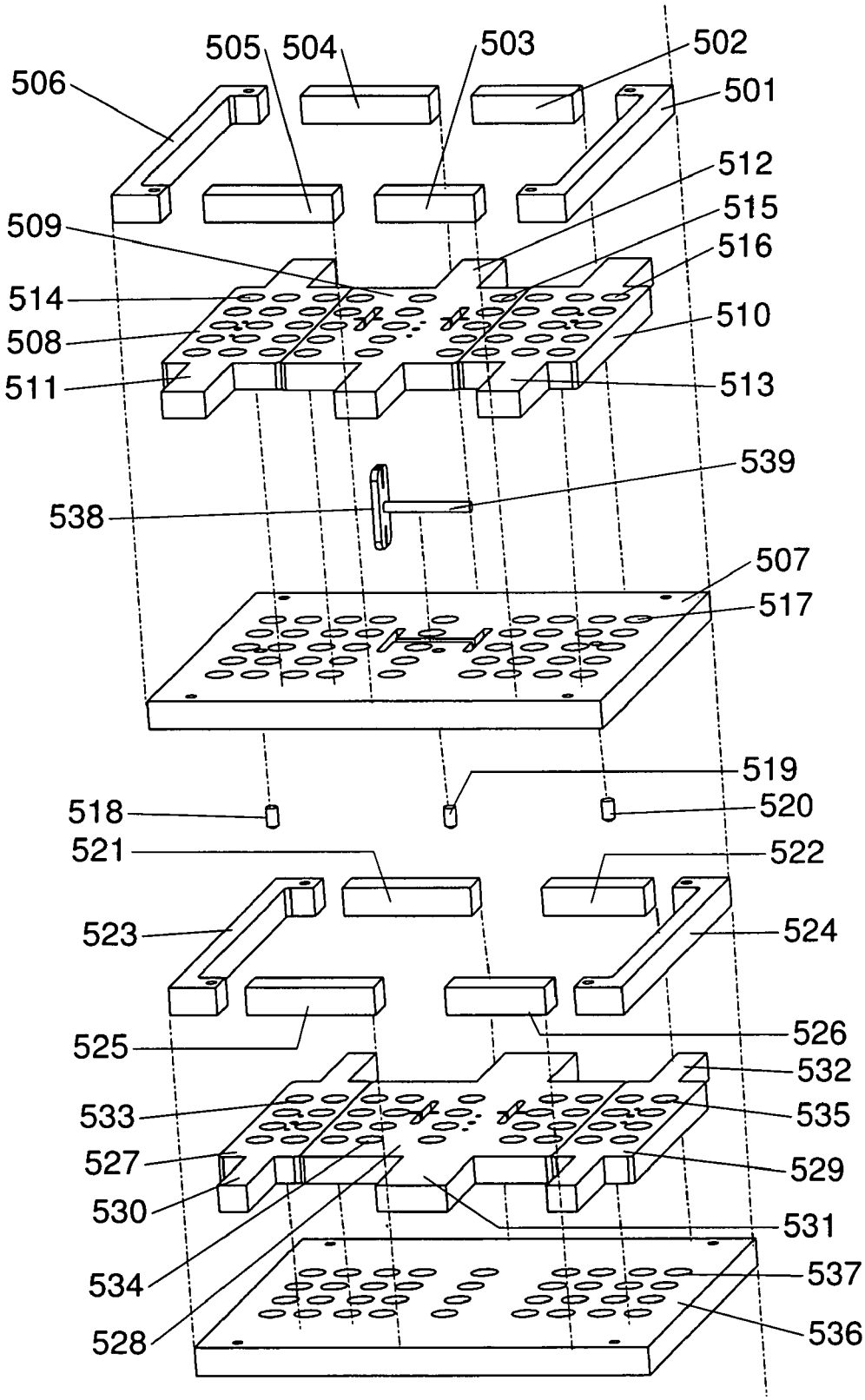
FIG. 5 is an exploded perspective view of the tenth, eleventh, twelfth and thirteenth layers of the apparatus.
Figure 6:
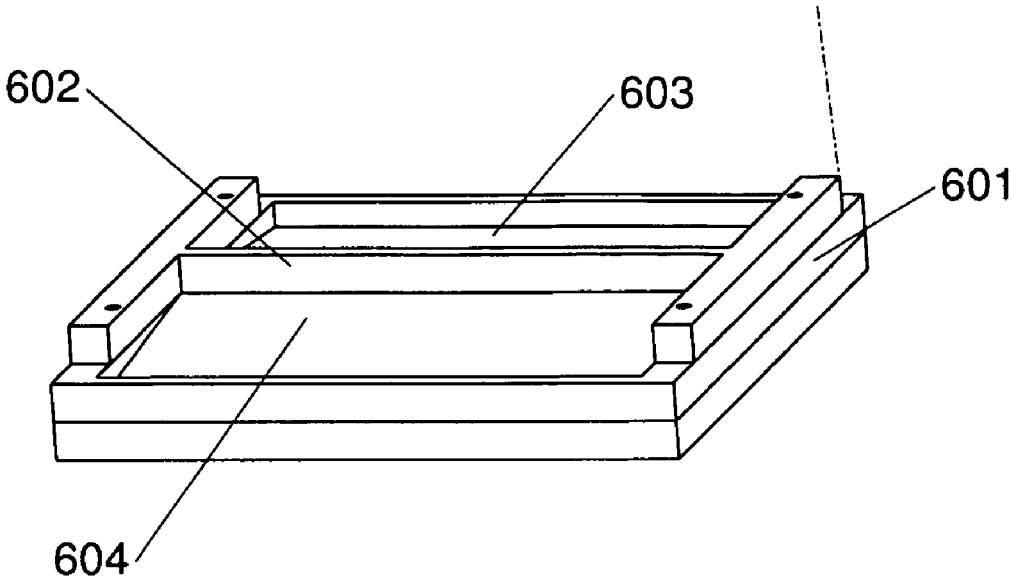
FIG. 6 is an exploded perspective view of the fourteenth, fifteenth, and sixteenth, layers of the apparatus.

FIG. 1 is an exploded perspective view of the entire game apparatus. FIG. 2 is an exploded perspective view detailing the top layer, the second layer and the third layer. FIG. 3 is an exploded perspective view detailing the fourth and fifth layer. FIG. 4 is an exploded perspective view detailing the sixth, seventh, eighth, and ninth layers. FIG. 5 is an exploded perspective view detailing the tenth, eleventh, twelfth, and thirteenth layers. FIG. 6 details the fourteenth, fifteenth, and sixteenth layers.

FIG. 7, and FIG. 7*a* are perspective views of the game apparatus in the assembled state. The orientation of the game apparatus is the same in FIG. 1, FIG. 2, FIG. 3, FIG. 4, FIG. 5, FIG. 6, and FIG. 7. A Top Side of the game apparatus is indicated by 701. A Right Side of the game apparatus is indicated by 702. A Near Side of the game apparatus is indicated by 703. The view of the game apparatus in FIG. 7*a* is approximately opposite from the view in FIG. 7. A Bottom Side of the game apparatus is indicated by 701*a*. A Left Side of the game apparatus is indicated by 702*a*. A Far Side of the game apparatus is indicated by 703*a*.

Overall Game Apparatus

In this embodiment the apparatus has pieces assembled as a frame and various movable pieces within the frame. In addition to the game apparatus, nine Game Objects 223, 224, 225, 226, 227, 228, 229, 230, and 231, are required for play. There are cavities within the frame. These cavities contain most of the movable pieces. Below most cavities in the frame there is a thickness of material. Portions of the frame and many of the movable pieces are formed with passageways. The moveable pieces with passageways are pucks and the Pair Start Assemblies. These passageways in these pieces form openings in the top and bottom surfaces of the pucks and portions of the Pair Start Assemblies. Each thickness of material in the frame below the cavities has passageways. These passageways form openings in the top and bottom surfaces of the cavities within the frame. These passageways allow the Game Objects to pass through the pucks and Pair Start Assemblies and from one cavity to another. The remaining movable pieces cause interactions between the movable parts with passageways.

The Game Objects may be of any size or shape that will pass through passageways and between any two adequately aligned passageways in the game apparatus due to the force of gravity. When passageways are described as aligned, the alignment is adequate to allow the Game Objects to pass between them by force of gravity.

The pucks and Pair Start Assemblies within the cavities can be moved to and between specific positions. These specific positions are Named Positions. In these Names Positions the passageways in the pucks and Pair Start Assemblies align with passageways in the frame. Depending on the specific position of the pucks and Pair Start Assemblies the alignment may be with the passageways above or below. As the pucks and Pair Start Assemblies are moved from one Named Position to another a first set of alignments is closed off and a second set opens. As these alignments are changed, the Game Objects move down through the apparatus.

Tracks

At the top of the apparatus there are nine passageways of a type indicated by and including 205. Each one of these is the first in nine independent series of passageways in the game apparatus. Each series contains a plurality of passageways throughout the layers of the game apparatus. Within a series, the individual passageways in one layer may or may not align with the passageways in the layers above or below depending on the current position of the pucks in the game apparatus. Each series of passageways is known as a Track. There is no alignment of passageways in any Track with the passageways of any other Track.

The Track closest to the Left Side of the game apparatus is Track 1. The Track just to the right of Track 1 is Track 2. The Track just to the right of Track 2 is Track 3. The Track just to the right of Track 3 is Track 4. The Track just to the right of Track 4 is Track 5. The Track just to the right of Track 5 is Track 6. The Track just to the right of Track 6 is Track 7. The Track just to the right of Track 7 is Track 8. The Track just to the right of Track 8 is Track 9.

Frame

The following parts are assembled into a frame. Left Game Start Frame Piece 201. Right Game Start Frame Piece 202. Pair Start Frame 204. Pair Start Static Frame 217. Front Rotary Frame Piece 301. Back Rotary Frame Piece 302. Cam Frame Piece, 303. Three Hole Frame Pieces, 403, 404, 405, 406, 407, and, 408. Three Hole Static Frame 417. Upper Four Hole Frame Pieces 424, 425, 426, 427, 428, and, 429. Upper 4 Hole Static Frame, 436. Five Hole Frame Pieces 501, 502, 503, 504, 505, and, 506. Five Hole Static Frame, 507. Lower Four Hole Frame Pieces 521, 522, 523, 524, 525, and, 526. Lower Four Hole Static Frame, 536. Collection Tray, 601.

FIG. 12 is a perspective view of the top of Cam Frame Piece, 303. FIG. 15 is a perspective view of the bottom of Cam Frame Piece, 303. FIG. 27 is a perspective view of the top of Three Hole Static Frame, 417. FIG. 33 is a perspective view of the top of Five Hole Static Frame, 507.

The sizes of the cavities formed by this frame are sufficient to contain the pucks. The fit of the pucks in the cavities is such that the pucks can move to and between the Named Positions.

Moveable Pieces

Some of the pucks and the Pair Start Assemblies can be moved in a linear motion between the Named Positions. Other pucks can be moved in a rotational motion between the Named Positions. The pieces that can be moved in a linear motion are the Game Start Piece 203, the Pair Start Assemblies 213, 214, 215, 216, the Ratchet Puck, 314, and the lower moveable pucks. The following are lower moveable pucks.

Left 3×3 Puck, 409. Odd Game Object Puck, 401. Right 3×3 Puck, 410. Left Upper 4×2 Puck, 430. Upper 4×5 Puck, 431. Right Upper 4×2 Puck, 432. Left 5×3 Puck, 508. Center 5×3 Puck, 509. Right 5×3 Puck, 510. Left Lower 4×2 Puck, 527. Lower 4×5 Puck, 528. Right Lower 4×2 Puck, 529. The pieces that can be moved in a rotational motion are rotatable pucks Left Rotary Puck, 304, and Right Rotary Puck, 305.

Each of the pucks and the Pair Start Assemblies have handles that extend outside the frame. These handles can be used to move the pieces. These are handles Back Game Start Control Handle, 206, Front Game Start Control Handle, 207, handle 306, handle 307, handle 315, handle 316, handles of the types 901, 418, 419, 420, 433, 434, 435, 511, 512, 513, 530, 531, and 532.

Game Start Piece

In FIG. 2 Game Start Piece 203 is shown in the Rest Position. In this Rest Position Game Start Piece 203 is at the limit of the available horizontal travel towards the Near Side of the game apparatus. When Game Start Piece 203 is moved to the limit of horizontal travel towards the Far Side of the game apparatus, it is in the Activated Position. When in the Activated Position the nine passageways of type 205 align with the eight passageways of type 208 and 210 in Pair Start Assemblies, 213, 214, 215, 216, and passageway 209 in Pair Start Frame 204 of the corresponding Tracks.

FIG. 8 shows a perspective view of Pair Start Frame 204. Movable Spring Block 211 is positioned in a cavity 801 in Pair Start Frame 204. Spring Block 211 is linked to a hole (not shown) in the bottom of Game Start Piece 203 by a pin 212. A compression spring (not shown) is located between Spring Block 211, and Pair Start Frame 204, and inside cavity 801. The spring lies partially within a hole (not shown) in the end of Spring Block 211. Spring Block 211 and this spring serve to return Game Start Piece 203 to the Rest Position from the Activated Position.

Pair Start Assemblies

FIG. 9 is a perspective view of an assembly of the same form as Pair Start Assemblies 213, 214, 215, and 216. Each assembly has a handle of type 901, a cross bar of the type 902, and two sliding bodies of type 903, and 904. The sliding bodies of these four assemblies lie in cavities of type 802 in Pair Start Frame 204. There are two sliding bodies in each cavity. The sliding bodies in each cavity are part of different Pair Start Assemblies. The cross bars and handles of Pair Start Assemblies 213, and 215, lie in channels formed in the top side of Pair Start Frame 204 of the appropriate dimensions to allow free sliding motion in the Near Side to Far Side direction of the game apparatus. The cross bars and handles of Pair Start Assemblies 214, and 216, lie in channels formed in the bottom side of Pair Start Frame 204 of appropriate dimensions to allow free sliding motion in the near to far direction of the game apparatus. Each of the sliding bodies of the types 903, and 904, has 1 passageway of the types indicated by 208, and 210.

In FIG. 2 the Pair Start Assemblies 213, 214, 215, and 216, are shown in their Rest Position. In this Rest Position the sliding bodies of Pair Start Assemblies 213, and 214, are at the limit of the available horizontal travel towards the Far Side of the game apparatus. In this Rest Position the Pair Start Assemblies 215, and 216, are at the limit of the available horizontal travel towards the Near Side of the game apparatus. When Pair Start Assemblies 213, and 214 are at the limits of available horizontal travel towards the Near Side of the game apparatus, these positions are known as the Activated Position. When the Pair Start Assemblies 215, and 216, are at the limits of available horizontal travel towards the Far Side of the game apparatus, these positions are known as the Activated Position. When the Pair Start Assemblies 213, 214, 215, and 216 are moved to the Activated Positions the eight passageways of the type indicated by 208, and 210 align with passageways of type 218 in Pair Start Static Frame 217 of the corresponding Tracks. Passageway 209 in Pair Start Frame 204 aligns with the passageway of the corresponding Track of type 218 in Pair Start Static Frame 217.

Eight compression springs (not shown) are located between the sliding bodies of types 903, and 904 of Pair Start Assemblies 213, 214, 215, and 216, and Pair Start Frame 204 inside cavities of the type 802. These springs lie partially within holes of type 905 in the ends of the sliding bodies of types 903, and 904. The remainders of the springs lie in the portion of the cavities not occupied by the sliding bodies when at the Rest Position. These compression springs serve to return the Pair Start Assemblies 213, 214, 215, and 216, to their Rest Positions from the Activated Positions.

Named Position Indication and Retention

All of the pucks other than the Game start Piece, 203, can be moved between and to three or more Named Positions. In this embodiment a retention system provides feedback to players about the position of these pucks. When in the Named Positions the player can feel the retention system engage the pucks. Players can easily overcome the retention and move the pucks from a Named Position. This retention is achieved by the use of ball plungers of the type shown in FIG. 10 and holes in the pucks.

FIG. 11 is an exploded perspective view of the assembly of FIG. 10. The ball plunger has a body 1101, a spring 1102, and a ball 1103. The exterior of body 1101 is cylindrical in shape with one closed end and one open end. The diameter of the exterior of body 1101 is such that it fits, and can be secured, within the holes indicated in the parts of the game apparatus described in this document. Body 1101 has a cylindrical interior cavity extending the majority of its length. The majority of this cylindrical interior cavity has a diameter sufficient for spring 1102, and ball 1103 to fit inside. Along the edge between the interior cavity of body 1101, and the end of body 1101 with the opening, there is a ridge 1104 that extends inward into the cylindrical cavity. This ridge extends inward into the cylindrical cavity and reduces the interior diameter of the cavity. Spring 1102 is a compression spring with an outside diameter that allows it to be inserted freely into the cavity in 1101 past the ridge. The diameter of ball 1103 is such that it fits freely inside the cavity of body 1101 but interferes with the ridge in the cavity. In the assembled state the ball plunger exists as follows. Spring 1102 is compressed between the closed end of body 1101, and ball 1103. Ball 1103 is near the open end of the cavity but retained in body 1101 by the ridge. In the assembled state ball 1103 protrudes from body 1101 and is held there by force of spring 1102. External forces can overcome the force of spring 1102 and push ball 1103 further into the body 1101. Upon removal of the external forces, spring 1102 forces ball 1103 to return to the original protruding position.

The ball plungers 220, 221, 222, 325, 326, 327, 421, 422, 423, 441, 442, 443, 518, 519, and, 520, are secured in vertical holes in the frame pieces. Specifically in three vertical holes of types 219 in Pair Start Static Frame, 217. In three vertical holes of type 1212, in Cam Frame Piece, 303. In three vertical holes of type 2701 in Three Hole Static Frame, 417. In three vertical holes of type 444 in Upper Four Hole Static Frame, 436. In three vertical holes of type 3301 in Five Hole Static Frame, 507. The ball plungers are secured with the balls of the ball plungers protruding from the bottom of the frame pieces.

They protrude by a distance that is less than half of the ball diameter but of sufficient distance for the ball to engage, in part, with the holes of the respective pucks of the game apparatus described as passing under the ball plunger later in this document.

Rotatable Pucks

Rotary Pucks 304, and 305, are affixed to Cam Frame Piece 303 with axles 323, and 324. The axles are fixed to Cam Frame Piece 303 in holes 1201, and 1202, so as to allow no relative movement. The axles are located in holes 310, and 311, in Rotary Pucks 304, and 305. The axles fit these holes so as to allow rotational movement.

The positions of the Rotary Pucks 304, and 305, shown in FIG. 3 are the Center Positions. When Rotary Pucks 304, and 305, are in the Center Positions each of the eight passageways of types 312, and 313, are aligned with one of the passageways of the corresponding Tracks of type 218 in Pair Start Static Frame 217.

For the purpose of this presentation the terms clockwise and counter clockwise are applied to the game apparatus as viewed from above. In each of Rotary Pucks 304, and 305, there are three holes of type 308, and 309. These holes are of a size appropriate to engage the ball of the ball plungers. These holes are all located at an equal radial distance from the center of the respective rotatable pucks in which they are located. An equal angular dimension separates the holes relative to center of Rotary Pucks 304, and 305. In this three-hole pattern there is a hole in the center of the pattern, a hole at a specific angular distance clockwise from the center hole of the pattern and a hole at an equal angular distance counter clockwise from the center hole of the pattern. These holes are of a size appropriate to engage the ball of the ball plungers. The center hole of these patterns are located such that when Rotary Pucks 304, and 305, are in the Center Position, the center hole aligns with the ball of the ball plungers 220, and 222, that are protruding from the bottom of Pair Start Static Frame 217. When the Rotary Pucks 304, or 305, are rotated in a clockwise direction from the Center Position until the hole that is counter clockwise from the center hole is aligned with the ball of the ball plungers 220, and 222, the pucks are in the Clockwise Position. When the Rotary Pucks 304, or 305, are rotated in a counter clockwise direction from the Center Position until the hole that is clockwise from the center hole is aligned with the ball of the ball plungers 220, and 222, the pucks are in the Counter Clockwise Position.

When Left Rotary Puck 304 is in the Clockwise Position each of the passageways of type 312 in Left Rotary Puck 304 align with one of passageways 1221, 1222, 1223, and 1224, in Cam Frame Piece 303. When Left Rotary Puck 304 is in the Counter Clockwise Position each of the passageways of type 312 in Left Rotary Puck 304 align with one of passageways 1231, 1232, 1233, and 1234, in Cam Frame Piece 303. When Right Rotary Puck 305 is in the Clockwise Position each of the passageways of type 313 in Right Rotary Puck 305 align with one of passageways 1241, 1242, 1243, and 1244, in Cam Frame Piece 303. When Right Rotary Puck 305 is in the Counter Clockwise Position each of passageways of type 313 in Right Rotary Puck 305 align with one of the passageways 1251, 1252, 1253, and 1254, in Cam Frame Piece 303.

Named Positions of the Lower Moveable Pucks

The lower moveable pucks Odd Game Object Puck, 401, Left 3×3 Puck, 409, Right 3×3 Puck, 410, Left Upper 4×2 Puck, 430, Upper 4×5 Puck, 431, Right Upper 4×2 Puck, 432, Left 5×3 Puck, 508, Center 5×3 Puck, 509, Right 5×3 Puck, 510, Left Lower 4×2 Puck, 527, Lower 4×5 Puck, 528, and Right Lower 4×2 Puck, 530, all can be moved to and between three Named Positions.

FIG. 14 is a perspective view of Odd Game Object Puck, 401. FIG. 26 is a perspective view of a puck of the same form as Left 3×3 Puck, 409, and Right 3×3 Puck, 410. FIG. 28 is a perspective view of a puck of the same form as Left Upper 4×2 Puck, 430, Right Upper 4×2 Puck, 432, Left Lower 4×2 Puck, 527, and Right Lower 4×2 Puck, 530. FIG. 29 is a perspective view of a puck of the same form as Upper 4×5 Puck, 431, and Lower 4×5 Puck, 528. FIG. 31 is a perspective view of a puck of the same form as Left 5×3 Puck, 508, and Right 5×3 Puck, 510. FIG. 32 is a perspective view of Center 5×3 Puck, 509.

Holes 1401, 1402, 1403, 3202, and holes of types 2601, 2602, 2801, 2802, 2901, 2902, 3101, 3102, and 3201, are of a size appropriate to engage with the balls of the ball plungers.

When holes 1402, 3202 and holes of types 2602, 2801, 2902, 3102 in each of the respective lower moveable pucks are aligned with the respective ball plungers in the frame pieces the lower moveable pucks are in their Center Positions.

When the lower moveable pucks are moved towards the Far Side of the apparatus until hole 1403 and holes of types 2601, 2802, 2901, 3101, and 3201, in each of the respective lower moveable pucks are aligned with the respective ball plungers the lower moveable pucks are their Backward Position. When the lower moveable pucks are moved towards the Near Side of the apparatus until hole 1401 and holes of types 2601, 2802, 2901, 3101, and 3201, in each of the respective lower moveable pucks are aligned with the respective ball plungers the lower moveable pucks are their Forward Position.

Passageway Rows and Columns

The passageways in Cam Frame Piece, 303, are formed at angles. The angles are such that the passageway openings form the patterns shown on the top and bottom of the Cam Frame Piece, 303 in FIG. 12 and FIG. 15. On the bottom, the openings form two rows of openings that run in the Left Side to Right Side direction of the apparatus. Each row has eight openings. On the bottom, the passageways also form eight columns of openings that run in the Near Side to Far Side direction of the apparatus. Each column has two openings. Each column belongs to a different Track.

The passageways in the Three Hole Static Frame, 417, the Upper Four Hole Static Frame, 436, the Five Hole Static Frame, 507, and the Lower Four Hole Static Frame, 536, are approximately vertical. The pattern formed by the openings of the passageways is approximately the same on the top and bottom of these frame pieces.

On the bottom of Three Hole Static Frame, 417, the passageway openings form three rows that run in the Left Side to Right Side direction of the apparatus. The rows closest to the Near Side and the Far Side of the apparatus each have nine openings. The center row has eight openings. The openings of the passageways on the bottom also form nine columns of openings that run in the Near Side to Far Side direction of the frame. The center column is incomplete and has only two openings. The other eight columns are complete with three openings in each.

On the top and bottom of Upper Four Hole Static Frame, 436, and Lower Four Hole Static Frame, 536, the passageway openings form four rows that run in the Left Side to Right Side direction of the apparatus. Each row has nine openings. The openings of the passageways on the top and bottom also form nine columns of openings that run in the Near Side to Far Side direction of the frame. Each column has four openings.

On the top and bottom of Five Hole Static Frame, 507, the passageway openings form five rows that run in the Left Side to Right Side direction of the apparatus. Each row has nine openings. The openings of the passageways on the top and bottom also form nine columns of openings that run in the Near Side to Far Side direction of the frame. Each column has five openings.

Passageway Alignments of Lower Moveable Pucks

When the lower moveable pucks are in their Center Positions the pattern of openings in the bottom of each puck matches the pattern of openings in the top surface of the frame piece directly below. With this match, each of the passageways in the pucks aligns with one of the passageways in the frame pieces directly below each respective puck. Specifically the passageways of type 413, 414, and 415, align with passageways of type 411. Passageways of types 438, 439, and 440, align with passageways of type 437. Passageways of types 514, 515, and 516, align with passageways of type 517. Passageways of type 533, 534, and 535, align with passageways of type 537.

When pucks 401, 409, and 410, are in the Forward Position the following passageways align. Each of the two passageways of types 413, 414, and 415, closer to the Far Side of the game apparatus in Pucks 401, 409, and 410 in Tracks 1, 2, 3, 4, 6, 7, 8, and 9 align with one passageway at the bottom of Cam Frame Piece 303. When Pucks 401, 409, and 410 are in the Backward Position the following passageways align. Each of the two passageways of types 413, 414, and 415 closer to the Near Side of the game apparatus in Pucks 401, 409, and 410 in Tracks 1, 2, 3, 4, 6, 7, 8, and 9 align with one passageways at the bottom of Cam Frame Piece 303.

When pucks 430, 431, and 432, are in the Forward Position the following passageways align. Each of the three passageways of types 438, 439, and 440, closer to the Far Side of the game apparatus in Pucks 430, 431, and 432, in each of the nine Tracks, align with one passageway of type 411 at the bottom of Three Hole Static Frame, 417. When pucks 430, 431, and 432, are in the Backward Position the following passageways align. Each of the three passageways of types 438, 439, and 440, closer to the Near Side of the game apparatus in Pucks 430, 431, and 432, in each of the nine Tracks, align with one passageway of type 411 at the bottom of Three Hole Static Frame 417.

When pucks 508, 509, and 510, are in the Forward Position the following passageways align. Each of the four passageways of types 514, 515, and 516, closer to the Far Side of the game apparatus in Pucks 508, 509, and 510, in each of the nine Tracks, align with one passageways of type 437 at the bottom of Upper Four Hole Static Frame 436. When pucks 508, 509, and 510 are in the Backward Position the following passageways align. Each of the four passageways of types 514, 515, and 516, closer to the Near Side of the game apparatus in Pucks 508, 509, and 510 in each of the nine Tracks, align with one passageways if type 437 at the bottom of Upper Four Hole Static Frame 436.

When pucks 527, 528, and 529, are in the Forward Position the following passageways align. Each passageway of types 533, 534, and 535, in each of the nine Tracks, align with one of the four passageways of type 517 in the bottom of the Five Hole Static Frame 507 closer to the Near Side of the game apparatus in the same Track. When pucks 527, 528, and 529, are in the Backward Position the following passageways align. Each passageways of types 533, 534, and 535, in each of the nine Tracks, align with one of the four passageways of type 517 in the bottom of Five Hole Static Frame 507 closer to the Far Side of the game apparatus in the same Track.

Named Positions of the Ratchet Puck

In the top of Ratchet Puck 314 there are five holes of type 318. These holes are of a size appropriate to engage the ball of the ball plungers. These holes are positioned on Ratchet Puck 314 in a single row with equal spacing between the holes. The row lies in the Near Side to Far Side direction. When Ratchet Puck 314 is in the Center Position the center hole of the row aligns with the ball of the ball plunger 221 that is protruding from the bottom of Pair Start Static Frame 217. When Ratchet Puck 314 is moved from the Center Position towards the Far Side of the game apparatus until the next hole of type 318 aligns with the ball of the ball plunger 221 Ratchet Puck 314 is in the Minus One Position. When Ratchet Puck 314 is moved from the Minus One Position towards the Far Side of the game apparatus until the next hole of type 318 aligns with the ball of the ball plunger 221 Ratchet Puck 314 is in the Minus Two Position. When Ratchet Puck 314 is moved from the Center Position towards the Near Side of the game apparatus until the next hole of type 318 aligns with the ball of the ball plunger 221 Ratchet Puck 314 is in the Plus One Position. When Ratchet Puck 314 is moved from the Plus One Position towards the Near Side of the game apparatus until the next hole of type 318 aligns with the ball of the ball plunger 221 Ratchet Puck 314 is in the Plus Two Position.

Passageway Alignments of Ratchet Puck

When Ratchet Puck 314 is in the Center Position, passageway 317 is aligned with the passageway of the corresponding Track of type 218 in Pair Start Static Frame 217.

FIG. 13 shows a perspective view of the bottom of Ratchet Puck 314. The lower level 1303 of Ratchet Puck 314 extends down into a cavity 1203 in Cam Frame Piece 303. The bottom surface of the lower level 1303 of Ratchet Puck 314 is approximately coplanar with the top surface of Odd Game Object Puck 401.

As Ratchet Puck 314, and Odd Game Object Puck 401 are moved among their respective Named Positions the passageway 317, in Ratchet Puck 314 may or may not align with either passageways 1404, or 1405, in Odd Game Object Puck 401. The following lists the combination of positions where an alignment occurs and which passageway in Odd Game Object Puck 401 aligns with passageway 317 in Ratchet Puck 314. When Ratchet Puck 314 is in the Plus Two Position and Odd Game Object Puck 401 is in the Center Position, passageway 317 aligns with passageway 1405. When Ratchet Puck 314 is in the Plus One Position and Odd Game Object Puck 401 is in the Backward Position passageway 317 aligns with passageway 1405. When Ratchet Puck 314 is in the Minus Two Position and Odd Game Object Puck 401 is in the Center Position passageway 317 aligns with passageway 1404. When Ratchet Puck 314 is in the Minus One Position and Odd Game Object Puck 401 is in the Forward Position passageway 317 aligns with passageway 1404.

Rotary Level Interaction Mechanism

In addition to moving Rotary Pucks 304, 305, and Ratchet Puck 314, by the handles attached to them, under certain circumstances motion imparted to Rotary Pucks 304, or 305, by a player, may cause motion of Ratchet Puck 314. This function is performed by the mechanism described in the following. FIG. 16 presents a bottom perspective view of either Rotary Puck 304 or 305. Two radial channels of rectangular cross section, 1601, and 1602, are shown. FIG. 17 is a perspective view of an assembly of the same type as Spring Pin Assemblies 319, 320, 321, and 322. FIG. 17*a* is an exploded view of an assembly of the same type as Spring Pin Assemblies 319, 320, 321, and 322. A rectangular prism shaped body, 1701, a pin fixed to one side of the body, 1704, and a pin protruding from within one end of the body, 1702 are shown. The body fits into the channels. FIG. 18 is a perspective view of the bottom of a puck of the same form as Rotary Pucks 304 or 305 with Spring Pin Assemblies inserted into channels. When the assemblies are fully inserted into the channel, the surface to which pin 1704 is affixed is approximately coplanar to the bottom surface of Rotary Pucks 304, or 305. The fit is such that the assemblies slide freely in the channels 1601, and 1602, in the radial direction of Rotary Pucks 304, and 305. Also, the fit is close enough that registration of the body to the inner surfaces of the channels is sufficient for the assembly to perform the functions described later.

FIG. 17*a* is an exploded perspective view of the assembly of FIG. 17. A compression spring 1701*a* is compressed between a plug 1702*a*, and pin 1702. In the assembled state plug 1702*a* is positioned and secured inside and near the opening of the cavity inside body 1701. Application of external forces on pin 1702 parallel to its axis will cause pin 1702 to retract into body 1701. Upon removal of these forces pin 1702 will return to the protruding position. Each of the four channels of type 1601, and 1602, contains one Spring Pin Assembly. The Spring Pin Assemblies are oriented in Rotary Pucks 304, and 305, as depicted in FIG. 18.

Channels 1204, and 1205, in Cam Frame Piece 303, are of rectangular cross section. The channels are of sufficient depth that the pins of type 1704 may extend fully into them without any interference. The width of the channels is such that the pins of type 1704 will fit into the channels, but still close enough to the diameter of the pins to perform the functions described in the following. With the Rotary Pucks 304, and 305, secured above Cam Frame Piece 303 via the aforementioned axles, the four pins of type 1704 protrude down into the channels 1204, and 1205. The radial locations of the four Spring Pin Assemblies relative to Rotary Pucks 304, and 304, are controlled by the contact of pins of type 1704 with the walls of channels 1204, and 1205. As Rotary Pucks 304, and 305, are rotated between the Clockwise Position, Center Position, and Counterclockwise Position, the bodies of type 1701 and subsequently the pins of type 1704 are also rotated around the axis of Rotary Pucks 304, and 305. This forces the pins of type 1704 through a portion of the length of the channels 1204, and 1205. Each channel, 1204, and 1205, consists of two semicircular channel sections, 1206, 1207, and 1208, 1209, and one deviating channel section 1210, and 1211. Channel sections 1210, and 1211 deviate from the semicircular path towards the center of the game apparatus. This deviation is shaped adequately to achieve the path of the Spring Pin Assemblies described later. When the pins of type 1704 are located in semicircular sections 1206, 1207, 1208, and 1209 the radial position of the entire assembly is such that the flat surface of pin 1702 lies close to the outer cylindrical surface of Rotary Pucks 304 or 305. This position is the Retracted Position. The Spring Pin Assembly in FIG. 18 closer to the top of the figure is shown approximately in the Retracted Position. When the pins of type 1704 are located in channel sections 1210, or 1211, the radial position of the entire assembly is such that the pin 1702 on the assembly protrudes well beyond the outer cylindrical surface of Rotary Pucks 304 or 305. This position is the Extended Position. The Spring Pin Assembly in FIG. 18 closer to the bottom of the figure is shown in the Extended Position.

FIG. 19 is an overhead view of the game apparatus with the top 3 layers removed. FIG. 19*a* is an overhead view of the game apparatus with the top 3 layers and Rotary Pucks 304, and 305, removed. FIG. 19 shows Rotary Pucks 304, and 305, in the Clockwise Position. In FIG. 19*a* shows the position of the Spring Pin Assemblies when Rotary Pucks 304, and 305, are in the Clockwise Position.

FIG. 20 is an overhead view of the game apparatus with the top 3 layers removed. FIG. 20*a* is an overhead view of the game apparatus with the top 3 layers and Rotary Pucks 304, and 305, removed. FIG. 20 shows Rotary Pucks 304, and 305, in the Center Position. FIG. 20*a* shows the position of the Spring Pin Assemblies when Rotary Pucks 304, and 305, are in the Center Position.

FIG. 21 is an overhead view of the game apparatus with the top 3 layers removed. FIG. 21*a* is an overhead view of the game apparatus with the top 3 layers and Rotary Pucks 304, and 305, removed. FIG. 21 shows Rotary Pucks 304, and 305, in the Counter Clockwise Position. FIG. 21*a* shows the position of the Spring Pin Assemblies when Rotary Pucks 304, and 305, are in the Counter Clockwise Position.

In FIG. 13 features of types 1301, and 1302 can be seen along both of the long edges of Ratchet Puck 314. Features of the type 1302 are flat surfaces approximately parallel to the short edges of Ratchet Puck 314. These flat surfaces of the type 1302 are of a size sufficient to allow the majority of the sides of pins of type 1702 to contact them. Features 1301 are flat surfaces positioned at an acute angle relative to the surface making up the majority of the long edge of Ratchet Puck 314. As pins of type 1702 contact and move across the surfaces 1301 while moveable pieces 304, and 305, are driven in a clockwise direction, the pins are driven into the bodies of type 1701. Under these situations, no motion of Ratchet Puck 314 occurs. There are four features of type 1301 on each side of Ratchet Puck 314. There are four features of type 1302 on each side of Ratchet Puck 314. The distance between the features of type 1302 is close enough to the spacing of the holes of type 318 to allow the functions described in the following to occur.

When Rotary Pucks 304, and 305, are moved clockwise from one Named Position to another, the pins of type 1704 will be forced through portions 1210, and 1211, of the channels. When this occurs, the Spring Pin Assemblies will be moved to the Extended Position. While in the Extended Position The pins of type 1702 may or may not contact a surface of type 1302 depending on the location of Ratchet Puck 314. Under counter clockwise rotation from one Named Position to another, a pin of type 1702 of the assemblies within Left Rotary Puck 304 will contact a surface of type 1302 when Ratchet Puck 314 is in the Plus Two Position, Plus One Position, Center Position, and Minus One Position. Under counter clockwise rotation from one Named Position to another, a pin of type 1702 of the assemblies within Left Rotary Puck 304 will contact the flat edge of Ratchet Puck 314 when Ratchet Puck 314 is in the Minus Two Position. When this occurs, no motion of Ratchet Puck 314 will occur. Under counter clockwise rotation from one Named Position to another, a pin of type 1702 of the assemblies in Right Rotary Puck 305 will contact a surface of type 1302 when Ratchet Puck 314 is in the, Plus One Position, Center Position, Minus One Position, and Minus Two Position. Under counter clockwise rotation from one Named Position to another, a pin of type 1702 of the assemblies within Right Rotary Puck 305 will contact the flat edge of Ratchet Puck 314 when Ratchet Puck 314 is in the Plus Two Position. When this occurs, no motion of Ratchet Puck 314 will occur. When the pins of type 1702 contact a surface of type 1302 during counterclockwise rotation of either Rotary Puck 304 or 305 motion will be imparted to Ratchet Puck 314. When this occurs, Ratchet Puck 314 will be driven from one Named Position to another. When this motion is imparted due to counterclockwise motion from one Named Position to another of Left Rotary Puck 304, Ratchet Puck 314 will move from one Named Position to another towards the Far Side of the game apparatus. When this motion is imparted due to counterclockwise motion from one Named Position to another of Right Rotary Puck 305, Ratchet Puck 314 will move from one Named Position to another towards the Near Side of the game apparatus.

Rotary Level Interaction Example

FIGS. 22, 23, 24, and 25, are all overhead views of the game apparatus with the top three layers removed. FIGS. 22*a*, 23*a*, 24*a*, and 25*a*, are all close-up overhead views of the game apparatus with the top three layers removed.

In FIG. 22 Left Rotary Puck 304 is shown in a position just counter clockwise from the Clockwise Position. In FIG. 22 Ratchet Puck 314 is shown in the Minus One position. FIG. 22*a* shows a close up view of the game apparatus in the same position as FIG. 22. In FIG. 22*a* a pin of type 1702 can be seen in a position approaching the Extended Position.

In FIG. 23 Left Rotary Puck 304 is shown in a position just counterclockwise from the position shown in FIG. 22. In FIG. 23 Ratchet Puck 314 is shown in a position slightly towards the Far Side of the game from the Minus One position. FIG. 23*a* shows a close up view of the game apparatus in the same position as FIG. 23. In FIG. 23*a* pin of type 1702, can be seen in the Extended Position and in contact with the surface of type 1302 on Ratchet Puck 314. As the pieces are moved, the motion of Left Rotary Puck 304 is imparted to Ratchet Puck 314 through the contact of the pin of type 1702 with the surface of type 1302.

In FIG. 24 Left Rotary Puck 304 is shown in a position just counterclockwise from the position shown in FIG. 23 and approaching the Center Position. In FIG. 24 Ratchet Puck 314 has been moved to and is shown in the Minus Two Position. FIG. 24*a* shows a close up view of the game apparatus in the same position as FIG. 24. In FIG. 24*a* pin of type 1702, can be seen approximately approaching the Retracted Position and no longer in contact with the surface of type 1302.

In FIG. 25 Left Rotary Puck 304 is shown in the Center Position. In FIG. 25 Ratchet Puck 314 is shown in the Minus Two Position. FIG. 25*a* shows a close up view of the game apparatus in the same position as FIG. 25. In FIG. 25*a* pin of type 1702, can be seen in the Retracted Position.

Level to Level Interaction Mechanisms

Pucks 401, and 431 are linked so that moving one of them will cause the other to move. Pucks 509 and 534 are linked in the same way. This is accomplished via the following mechanisms.

FIG. 30 is a perspective view of a Linkage Lever piece of the same form as pieces 412, and 538. A hole of type 3001 in Linkage Lever 412 is fitted over an axle 416 as shown in FIG. 4. A hole of type 3001 in Linkage Lever 538 is fitted over axle 539 as shown in FIG. 5. The fit of the holes to the axles allows the Linkage Levers to be rotated around the axle. The fit is close enough to allow the linkage lever to perform the function described in the following. A portion of the length of the axle 416 extends through and is secured to channel 2702 of Three Hole Static Frame 417. A portion of the length of the axle 539 extends through and is secured to channel 3302 of Five Hole Static Frame 507. The axes of the axles are located at approximately the middle height of Static Frames. In the assembled state Linkage Lever 412 is in slot 2703. In the assembled state Linkage Lever 538 is in slot 3303. The Linkage Levers extend above and below the respective frame pieces by an equal amount.

Slot 1406 is in puck 401. Pin 1407 is secured a distance from the bottom of Puck 401. Pin 1407 extends across slot 1406. Slot 1406 is of a size such that Linkage Lever 412 will fit into the slot. A slot of type 2903 is in Puck 431. A pin of type 2904 is secured a distance from the top of Puck 431. That distance is approximately equal to the distance from pin 1407 to the bottom of puck 401. The pin of type 2904 extends across slot of type 2903 in puck 431. In the assembled state, pin 1407, and the pin of type 2904, within Pucks 401, and 431, are located within the slots 3002, and 3003 of Linkage Lever 412.

Linkage Lever 412 links Pucks 401, and 431 so that their positions are related as follows. When Puck 401 is in the Forward Position Puck 431 will be in the Backward Position. When Puck 401 is in the Backward Position Puck 431 will be in the Forward Position. When Puck 401 is in the Center Position Puck 431 will be in the Center Position.

Slot 3203 is in puck 509. Pin 3204 is secured a distance from the bottom of Puck 509. Pin 3204 extends across slot 3203. Slot 3203 is of a size such that Linkage Lever 538 will fit into the slot. A slot of type 2903 is in Puck 528. A pin of type 2904 is secured a distance from the top of Puck 528. That distance is approximately equal to the distance from pin 3204 to the bottom of puck 509. The pin of type 2904 extends across slot of type 2903 in puck 528. In the assembled state, pin 3204, and pin of type 2904, within Pucks 509, and 528, are located within the slots 3002, and 3003 of Linkage Lever 538.

Linkage Lever 530 links Pucks 509, and 528 so that their positions are related as follows. When Puck 509 is in the Forward Position Puck 528 will be in the Backward Position. When Puck 509 is in the Backward Position Puck 538 will be in the Forward Position. When Puck 509 is in the Center Position Puck 538 will be in the Center Position.

Collection Tray Level

The Collection Tray has a divider 602 and two inclined panels 603, and 604. The divider is positioned in the Near Side to Far Side direction of the game apparatus so that half of the passageways in Lower 4 Hole Static Frame 536 are on the Far Side of the divider and the other half are on the Near Side of the divider. Game Objects dropping from the passageways 537 will drop on one or the other side of the divider. The panels are inclined to move the Game Objects towards the Near Side or Far Side of the game apparatus for easy retrieval by the players.

Operation

The game apparatus is prepared for play by placing all of the moveable pucks and all of the rotatable pucks in their center positions. The game apparatus has nine passageways of type 205 in the top layer where players place all nine Game Objects. One Game Object is placed in each passageway. Once the Game Objects are in the passageways, moving Game Start Piece 203 to the Activated Position begins play. Play then consists of the first player moving a handle to move one moveable piece or one rotatable piece from one Named Position to an adjacent Named Position. Then the second player does the same. Play continues with each player moving one handle from one Named Position to an adjacent Named Position per turn. When played as a two-player game, one player plays the game associated with the Near Side of the game apparatus. The other player plays associated with the Far Side of the game apparatus. The goal of each player is to move the movable pieces in the game apparatus in such a manner as to control the paths of the Game Objects down through the game apparatus. The outcome of the game is then determined in relation to the number of Game Objects each player directs into each side of the Collection Tray. Typically the player who directs the most Game Objects into the side of the Collection tray to which they are associated is the winner. As a one-player game, the player may attempt specific tasks such as the minimum number of moves to move all of the Game Objects through the game apparatus. Or, predicting and controlling the paths of the Game Objects.

CONCLUSIONS, RAMIFICATIONS, AND SCOPE

The objective of the game apparatus is to create a mechanical field of play where players must use knowledge, memory, and strategy to gain advantage. This advantage may be against just the game apparatus when played by one player. Or, the advantage may be gained against both the game apparatus and another player when played as a two-person game. In the case of transparent or translucent materials, the challenge is less, as the players do not have to track the Game Objects by way of knowledge and memory. When constructed of opaque materials, the players must use knowledge of the internal construction of the game apparatus and remember or record the moves made previously in the game in order to track the paths of the Game Objects. They must also use their knowledge of the internal construction of the game apparatus in order to plan their strategy.

Performance of the first move presents an inherent advantage to a player in games of this nature. In order to minimize that advantage, a mechanism that presents a balanced and complex field of play to the two players is presented. Despite the advantage of the first move, predicting the outcome of play through the Pair Start Levels, Rotary Levels, and the Three Hole Levels is a challenge to most players. This challenge is made up of several factors related to the apparatus. One factor is the release of the Game Objects by the Pair Start Assemblies in a balanced situation relative to the interaction of the Rotary Pucks 304 and 305 and the Ratchet Puck 314. This balance creates a situation where players may compete for many turns before the outcome of the play of the Pair Start Levels and the Rotary Levels is determined. In particular, the Game Object in Track 5 represents an Odd Game Object where control of it can be the difference between controlling the paths of less or more than half of the Game Objects in the apparatus. It requires two moves of Ratchet Puck 314 or one move of Ratchet Puck 314 and one move of Odd Game Object Puck 401 to move the Game Object in Ratchet Puck 314 far enough to fall to the next level down. Many other moves may occur before this is accomplished. Another factor is the large number of possible move sequences. The number of possible move sequences is large enough to be difficult for most players to consider. Another factor is the interaction of Rotary Pucks 304, and 305, and the Ratchet Puck 314. This requires the players to consider the movement of the Ratchet Puck 314 relative to the movements of Rotary Pucks 304, and 305.

The transfer of counterclockwise motion from Rotary Pucks 304, and 305, to Ratchet Puck 314 is significant in the play of the game. When played as a two player game, the typical object of the game is to manipulate the game handles so that more of the Game Objects end up in the collection tray on a player's side than in the collection tray on the opposing player's side. In the attempt to achieve this goal, the players move the moveable pieces containing Game Objects in a fashion that moves them towards the side with the desired collection tray. When a player moves a movable piece or interactive moveable pieces with more than one Game Object in their passageways, the player may gain an advantage.

In order to balance this potential advantage of the rotary level interaction, the Pair Start Assemblies are positioned within the game apparatus to transfer the Game Objects to the layers below in four pairs. When these pairs of Game Objects drop into the passageways in Rotary Pucks 304, and 305, two of the pairs present one type of scenario to the players and the other two pairs present a reversed scenario to the players.

Specifically, when the pair of Game Objects in Track 1, and Track 6, or the pair of Game Objects in Track 2, and Track 7, are dropped and progress at the same time into the passageways in Rotary Pucks 304, and 305, four possible moves are presented. The first possible move moves a Game Object inside Left Rotary Puck 304 towards the Near Side and may move Ratchet Puck 314 via the Countering Ratchet Mechanism towards the Far Side. A second possible move moves a Game Object inside Left Rotary Puck 304 towards the Far Side and has no affect on Ratchet Puck 314. A third possible move moves a Game Object inside Right Rotary Puck 305 towards the Near Side and may move Ratchet Puck 314 via the Countering Ratchet Mechanism towards the Near Side. The fourth possible move moves a Game Object inside Right Rotary Puck 305 towards the Far Side and has no affect on Ratchet Puck 314. Thus, the possibilities are as follows. Two where the Game Objects can be moved towards the Near Side of the game apparatus with the possibility of affecting the position of Ratchet Puck 314 and two where the Game Objects can be moved towards the Far Side without affecting the position of Ratchet Puck 314. Of the two moves that may affect the position of Ratchet Puck 314, one is in favor of one player and the other in favor of the other player.

The pair of Game Objects in Track 3, and Track 8, or the pair of Game Objects in Track 4, and Track 9, present a mirrored scenario. In that scenario there are the following moves. Two where the Game Objects can moved towards the Far Side of the game apparatus with the possibility of affecting the position of Ratchet Puck 314 and two where the Game Objects can be moved towards the Near Side without affecting the position of Ratchet Puck 314. Of the two moves that may affect the position of Ratchet Puck 314, one is in favor of one player and the other in favor of the other player.

The described possible moves of the pairs of Game Objects arriving at the same time in Rotary Pucks 304, and 305, and the potential for also affecting Ratchet Puck 314 and the Game Object in its passageway presents a balance of play to the players. This balance is such that if all four pairs of Game Objects arrive in the passageways Rotary Pucks 304, and 305, at the same time there is no advantage presented to either player. When played as a two-player game, the players have the ability to disrupt this balance by interspersing moves of Rotary Pucks 304, and 305, between activating the Pair Start Assemblies 213, 214, 215, and 216. By doing so the players may affect the timing of the Game Object's arrivals in Rotary Pucks 304, and 305. Strategies exist with regards to disrupting this balance that can provide a player an advantage in this portion of the game apparatus. These strategies can also be timed to take advantage of the play in the lower parts of the game apparatus. In the lower parts, moveable Upper 5×4 Puck 431 is linked to Odd Game Object Puck 401. If a desired move of Upper 5×4 Puck 431 can be timed to cause one of the passageways in Odd Game Object Puck 401 to align with the passageway in Ratchet Puck 314 as the play in the upper parts of the apparatus unfold, the player may gain advantage.

The linking of Puck 401 and Puck 431 and the linking of Puck 509 and Puck 528 provides additional opportunities for the players to gain advantage as they move the Game Objects down through the game apparatus. It is possible to move multiple Game Objects on different levels to a player's advantage. It is also possible for the other player to disrupt this sort of strategy.

The combination of the various portions of the apparatus and the large number of possible paths challenges even a single player to predict and control the paths of the Game Objects down through the apparatus. Adding a second player who is attempting to disrupt and counter the efforts of the first adds a significant level of complication and challenge. This is particularly true because of the arrangement of the presented mechanisms. Thus the reader will see that at least one embodiment of the game apparatus provides a challenging game to two players.

While my above description contains many specificities, these should not be construed as limitations on the scope, but rather as an exemplification one preferred embodiment thereof. Many other variations are possible. For example the number of Tracks in the game apparatus parts could be varied. This could be done in several manners with regard to the balance of play previously described.

Increasing the number of Tracks so that the following are met would result in variations with the same type of balance as the described embodiment. A number of Tracks in the game apparatus less those passing through the Ratchet Puck that can be divided into an even number of assemblies performing the same function as the Pair Start Assemblies in the described embodiment. It would also be necessary for each assembly to contain an equal number of sliding bodies, an equal number of passageways, an even number of sliding bodies, an even number of passageways, and an equal number of passageways in each sliding body. It would also be necessary for the sliding bodies to be placed in a balanced pattern in relation to the rotatable pucks. The number of passageways in the Ratchet Puck could be increased. In order to maintain the same balance it would also be necessary for the total number of passageways in the Ratchet Puck to be an odd number.

Using the same mechanisms as the described embodiment, the number of Tracks can be reduced to create an game apparatus that presents a different balanced field of play. An embodiment similar to the described embodiment but differing only in the following manner would be examples of this. Any combination of the following pairs of Tracks other than all of them would not be present. Track 1 and Track 9, Track 2 and Track 8, Track 3 and Track 7, Track 4 and 6. The described embodiment can be used to play these alternates by simply omitting the Game Objects in these Tracks.

More complex versions with the similar type of balance as those described in the previous paragraph can be created. This would require a number of Tracks in the game apparatus less those passing through the Ratchet Puck that can be divided into an even number of assemblies performing the same function as the Pair Start Assemblies in the described embodiment. It would also require the collection of assemblies be such that it may be divided into two equal subsets. Each subset could contain assemblies of various forms. But for each assembly of a form in one subset there would need to be an assembly of the same form in the other subset. Any two assemblies from the two subsets that are of the same form would make a matched pair. A matched pair being such that both assemblies have an equal number of sliding bodies located in a same position in each assembly with the same number of passageways in each said sliding body. It would also require the members of each subset to be positioned in a pattern around the Rotary Pucks that mirrors the other subset. In order to create this balance it would also be necessary for the total number of passageways in the Ratchet Puck to be an odd number.

The Cam Frame Piece could be thicker. The passageways in the Cam Frame Piece that align with the passageways in the Rotary Pucks could be formed at different angles so that the openings of the passageways at the bottom of the Cam Frame Piece form more than two rows. In this configuration the number of openings in each row would be reduced by the same factor as the number of rows were increased. This would result in a situation where not all positions of the grid formed by the rows and columns of openings in the bottom of the Cam Frame Pieces would have an opening present. In this situation, if the pucks just below the Cam Frame Piece were formed with complete rows and columns of passageways and openings, only some of the openings on the top surfaces of the pucks would align with the passageways present in the bottom surface of the Cam Frame Piece. To be balanced, this would require an even number of rows and a balanced pattern with regards to which passageways lead to each row. This would also require the next level below the Cam Frame Piece to have at least one more row of passageways than the Cam Frame Piece.

The number of Named Positions of the Ratchet Puck could be increased. With this, more moves of the Ratchet Puck would required before the Odd Game Object drops to the next level. The only constraint on the number of positions of the Ratchet Puck would be an odd numbered plurality of positions. The number of Named Positions of the Rotary Pucks could be increased. This could be done so that more Rotary Puck moves are required for all of the passageways in the Rotary Pucks to align with the passageways in the Cam Frame Piece. This could also be done so that the various passageways would require various numbers of moves of the Rotary Pucks to align with the passageways in the Cam Frame Piece. The only constraint on the number of positions of the Rotary Pucks would an odd numbered plurality of positions. It would also be necessary to increase the number of channels in the bottom of the Rotary Pucks and the number of Spring Pin Assemblies.

The use of ball plungers to locate the pucks in the named positions could be replaced by any means that indicates to the players that the puck is in the named positions. Simple marks on the handles could perform this function.

There can be more levels of the same types as the Upper Four Hole Level, and the Five Hole Level, and the Lower four Hole Level. There can be levels of types similar to the Upper Four Hole Level, and the Five Hole Level, and the Lower four Hole Level differing only by the number of passageways in the Near Side to Far Side direction. There can be layers of types similar to the Upper Four Hole Level, and the Five Hole Level, and the Lower four Hole Level differing only by the number of Tracks. There can be layers of types similar to the Upper Four Hole Level, and the Five Hole Level, and the Lower four Hole Level, differing only by the number of pucks per level. The width of the pucks and the number of passageways in each puck in the Left Side to Right Side direction can be varied. The stacking of layers similar to the Upper Four Hole Level, and the Five Hole Level, and the Lower four Hole Level can be of any possible combination of any number of levels. There can be any combination of the just listed differences.

With regards to these variations the requirements for a functional game apparatus would be as follows. The number of Tracks in a game apparatus must be consistent through all Levels. The number of passageways in the Front Side to Rear Side direction in one Level located below another Level must be no more than one different than the layer above and not equal to the layer above.

There can be more and different types of Level to Level interactions. Pucks in any position within a level can be linked to pucks of the same position in an adjacent level. Using longer linking levers and appropriately positioned slots and appropriately positioned pivot points there can be Level to Level interactions between any two levels.

The thickness of any part of the game apparatus could be varied. The angles of the passageways could be varied. The shapes of the Pucks could be varied. It would only be necessary for Pucks to have the following characteristics. The Pucks would need to encompass the passageways sufficiently to contain the Game Objects inside. The Pucks would need to cover the passageways in the levels above when in the Center Position sufficiently to hold Game Objects in those passageways. The Pucks would need to be such that they could slide between the Named Positions. The Pucks would need to have surfaces so that the openings of the passageways can be adequately aligned with the passageways in the frame pieces to allow the Game Objects to pass between them by force of gravity.

The direction of rotation of the Rotary Pucks that transmits motion to the Ratchet Puck can be reversed. The type of mechanism that translates the movement of the Rotary Pucks into movement of the Ratchet Puck could be different. Frictional elements could be used. Electromechanical means could be used. The direction the Ratchet Puck moves in response to the direction the Rotary Pucks could be reversed.

The construction of the game apparatus can also be varied. The separate Frames pieces in the described embodiment can be formed in many forms. The Frame pieces in the entire game apparatus can be formed as a single piece with allowances for inserting the movable pieces. The stationary pieces can be formed in any number of pieces.

Accordingly the scope should be determined not by the embodiment illustrated, but by the claims and their legal equivalents.

I claim:

1. A game apparatus comprising:

a. an odd numbered plurality of game objects, an even numbered plurality of assemblies each having one or more sliding bodies, two rotatable pucks, one upper moveable puck, one or a plurality of lower moveable puck(s) including one odd game object puck, a frame of form sufficient to hold said assemblies and said two rotatable pucks and said upper moveable puck and said one or a plurality of lower moveable puck(s) including said odd game object puck in positions relative to each other;

b. said sliding bodies having a top surface and a bottom surface, said assemblies having a means to connect each said sliding body to another said sliding body within each said assembly, said sliding bodies having one or more passageways, said passageways extending from said top surface to said bottom surface of said sliding body, said passageways forming openings in said top surface and said bottom surface of said sliding bodies;

c. said two rotatable pucks having a top surface and a bottom surface, said two rotatable pucks having one or more passageways, said passageways extending from said top surface to said bottom surface of said two rotatable pucks, said passageways forming openings in said top surface and said bottom surface of said rotatable pucks, an equal number of said passageways in a first of said two rotatable pucks as a number of said passageways in a second of said two rotatable pucks, a total number of said passageways in both said two rotatable pucks being an even numbered plurality of passageways, said total number of passageways in both said two rotatable pucks being equal to a total number of passageways in all said sliding bodies in all said assemblies;

d. said upper moveable puck having a top surface and a bottom surface, said upper moveable puck having one or an odd numbered plurality of passageway(s), said passageway(s) extending from said top surface to said bottom surface of said upper moveable puck, said passageway(s) forming openings in said top surface of said upper moveable puck;

e. said one or a plurality of lower moveable puck(s) having a top surface(s) and a bottom surface(s), said lower moveable puck(s) having a plurality of passageways, said passageways extending from said top surface(s) to said bottom surface(s) of said lower moveable puck(s), said passageways forming openings in said top surface(s) and said bottom surface(s) of said lower moveable puck(s);

f. said frame being of a form with a top side and a bottom side, said top side being positioned so that the force of gravity is directed against and approximately normal to a plane defined by said top side, said frame of being a form with a front side a back side a left side and a right side;

g. said frame having sliding body cavities forming openings at said top side of said frame, said sliding body cavities being of a number and size sufficient to contain all of said sliding bodies of said assemblies, said sliding bodies being within said sliding body cavities, said sliding body cavities being open on said top side of said frame sufficiently so that said passageways in said sliding bodies are accessible by game players;

h. said frame having an upper moveable puck cavity located a first distance below said sliding body cavities, said upper moveable puck cavity being of a size sufficient to contain said upper moveable puck, said upper moveable puck being within said upper moveable puck cavity, said frame having two rotatable puck cavities located a second distance below said sliding body cavities, said two rotatable puck cavities located a second distance below said sliding body cavities being located on either side of said upper moveable puck cavity in said right side to said left side direction of said frame, each of said two rotatable puck cavities being of a size sufficient to contain one of said rotatable pucks, said two rotatable pucks being within said two rotatable puck cavities;

i. said frame having a lower moveable puck(s) cavity being located a distance below said rotatable puck cavities and said upper moveable puck cavity, said lower moveable puck(s) cavity being of a size sufficient to contain said lower moveable puck(s), said lower moveable puck(s) being within said lower moveable puck(s) cavity;

j. said frame having a first thickness of material below said sliding body cavities, said first thickness of material extending from said sliding body cavities to said rotatable puck cavities and said upper moveable puck cavity, said first thickness of material having a plurality of passageways, said passageways extending from said sliding body cavities to said rotatable puck cavities, said passageways forming openings in said bottom surface of said sliding body cavities, said passageways forming openings in said top surface of said rotatable puck cavities, said passageways being of a number equal to a number of passageways in both said two rotatable pucks, said passageways being positioned so that for each said passageway in each said sliding body in each said sliding body cavity there is one opening of said passageways in said bottom surface of each respective said sliding body cavity, said passageways being positioned so that for each said passageway in said two rotatable pucks there is one said opening of said passageways in said top surface of each respective said rotatable puck cavity;

k. said frame having a second thickness of material below said rotatable puck cavities and said upper moveable puck cavity, said second thickness of material extending from said rotatable puck cavities and said upper moveable puck cavity to said lower moveable puck(s) cavity, said second thickness of material having a plurality of passageways, said passageways extending from said rotatable puck cavities to said lower moveable puck(s) cavity, said passageways forming openings in said bottom surface of said rotatable puck cavities, said passageways forming openings in said top surface of said lower moveable puck(s) cavity, said passageways being of a number equal to twice a total number of said passageways in said two rotatable pucks, said passageways being formed at an angle or angles necessary so that said openings in said top surface of said lower moveable puck(s) cavity are positioned in an even numbered plurality of approximate rows, said even numbered plurality of approximate rows being so that a first distance between any two of said even numbered plurality of approximate rows is approximately equal to a second distance between any other two of said even numbered plurality of approximate rows, said even numbered plurality of approximate rows being approximately parallel to a line normal to said left side of said frame, a first half of said even numbered plurality of approximate rows being located closer to said front side of said frame than a second half of said even numbered plurality of approximate rows and said second half of said even numbered plurality of approximate rows being located closer to said back side of said frame than said first half of said even numbered plurality of approximate rows, said openings in said top surface of said lower moveable puck(s) cavity being positioned in approximate columns, said approximate columns being approximately parallel to a line normal to said front side of said frame, said passageways being positioned so that for each said passageway in a first of said two rotatable pucks there are two said openings in said bottom surface of a specific said rotatable puck cavity with said first of said two rotatable pucks within, said passageways being positioned so that for each said passageway in a second of said two rotatable pucks there are two said openings in said bottom surface of a specific said rotatable puck cavity with said second of said two rotatable pucks within;

l. said second thickness of material having an extension cavity directly below said upper moveable puck, said extension cavity extending from said bottom surface of said upper moveable puck cavity to said lower moveable puck(s) cavity, said upper moveable puck having a fourth thickness of material extending down from said bottom surface of said upper moveable puck into said extension cavity, said fourth thickness of material extending down from said bottom surface of said upper moveable puck is such that there is a bottom surface of said fourth thickness of material, said fourth thickness of material being such that said one or odd numbered plurality of passageway(s) in said upper moveable puck extend down through said fourth thickness of material, said one or odd numbered plurality of passageways(s) in said upper moveable puck forming openings in said bottom surface of said fourth thickness of material, said extension cavity being of a size that said upper moveable puck will not fall through by force of gravity when said upper moveable puck is in any position, said extension cavity being of a size that it will allow said upper moveable puck and said fourth thickness of material to be moved between and to any said distinct positions;

m. said frame having a third thickness of material below said lower moveable puck(s) cavity, said third thickness of material extending from said lower moveable puck(s) cavity to said bottom side of said frame, said third thickness of material having a plurality of passageways, said passageways extending from said lower moveable puck(s) cavity to said bottom side of said frame, said passageways forming openings in said bottom surface of said lower moveable puck(s) cavity, said passageways forming openings in said bottom side of said frame, said passageways being such that said openings in said bottom surface of said lower moveable puck(s) cavity and said openings in said bottom side of said frame are arranged in both a plurality of approximate rows and a plurality of approximate columns, said approximate rows being approximately parallel to a line normal to said left side of said frame, said approximate columns being approximately parallel to a line normal to said front side of said frame, said approximate rows being so that a first distance between any two of said rows is approximately equal to a second distance between any other two of said approximate rows, said approximate rows being so that a distance between any two rows of said approximate rows is approximately equal to a distance between any two said even numbered plurality of approximate rows of said openings in said top surface of said lower moveable puck(s) cavity, said approximate columns including a number of complete columns and a number of incomplete column(s), said number of said incomplete columns being equal to said one or an odd numbered plurality of passageway(s) in said upper moveable puck, said incomplete columns each consisting of two of said openings, said number of said complete columns being equal to a total number of said passageways in both said two rotatable pucks, said approximate rows of said complete columns being of a number greater than said even numbered plurality of approximate rows of said openings at said top of said lower moveable puck(s) cavity by one, said approximate rows of said complete columns being of an odd numbered plurality of rows, said approximate rows of said complete columns being positioned in a front side to said back side direction of said frame so that a first half of said even numbered plurality of approximate rows of openings in said top surface of said lower moveable puck(s) cavity are closer to said front side of said frame than a center row of said approximate rows of said complete columns, said approximate rows of said complete columns being positioned in said front side to said back side direction of said frame so that a second half of said even numbered plurality of approximate rows of openings in said top surface of said lower moveable puck(s) cavity are closer to said back side of said frame than said center row of said rows of said complete columns;

n. said sliding body cavities being of a size in a horizontal direction parallel to a horizontal line normal to said front side of said frame that allows said assemblies to be moved from a first distinct position to a second distinct position and back in a horizontal direction parallel to a horizontal line normal to said front side of said frame;

o. said game apparatus having a means by which said assemblies are identified as being in each of said distinct positions relative to said frame, said distinct positions being such that when said assemblies are in said second distinct position each said opening of said passageways in said bottom surfaces of said sliding bodies align with an opening of said passageways in said bottom surface of said sliding body cavities, said distinct positions being such that when said assemblies are in said first distinct position no said openings of said passageways in said sliding bodies aligns with any other said opening;

p. said sliding body cavities being of a size in all directions other than in a horizontal direction parallel to a horizontal line normal to said front side of said frame that retains said assemblies with sufficient accuracy that said openings in said bottom surfaces of said sliding bodies align with said openings in said bottom surfaces of said sliding body cavities when said assemblies are in said second distinct positions;

q. said upper moveable puck cavity being of a size in a horizontal direction parallel to a horizontal line normal to said front side of said frame that allows said upper moveable puck to be moved between and to an odd numbered plurality of distinct positions in a direction parallel to a line normal to said front side of said frame, said game apparatus having a means by which said upper moveable puck is identified as being in each of said odd numbered plurality of distinct positions relative to said frame, said frame having passageway(s) equal in number to said one or an odd numbered plurality of said passageway(s) in said upper moveable puck, said passageway(s) being positioned so that for each said opening in said top surface of said upper moveable puck there is one said opening in said top surface of said upper moveable puck cavity, said passageway(s) extending from said top side of said frame down to said top surface of said upper moveable puck cavity, said passageway(s) forming opening(s) in said top side of said frame, said passageway(s) forming opening(s) in said top surface of said upper moveable puck cavity, said opening(s) in said top surface of said upper moveable puck cavity aligning with said opening(s) in said top surface of said upper moveable puck when said upper moveable puck is in a center distinct position of said odd numbered plurality of distinct positions;

r. said upper moveable puck being such that when said upper moveable puck is in any distinct position other than said center distinct position of said odd numbered plurality of distinct positions said top surface of said upper moveable puck covers said openings in said top surface of said upper moveable puck cavity so that any game objects in said passageways forming said openings in said top surface of said upper moveable puck cavity remain in said passageways;

s. said upper moveable puck cavity being of a size in all directions other than in a horizontal direction parallel to a horizontal line normal to said front side of said frame that said upper moveable puck retains said upper moveable puck with sufficient accuracy that said openings(s) in said upper moveable puck align with said opening(s) in said top surface of said upper moveable puck cavity and with said opening(s) in said top surface of said odd game object puck;

t. said rotatable puck cavities being such that said two rotatable pucks can be rotated around an approximately vertical center of rotation between and to an odd numbered plurality of distinct positions, said game apparatus having a means by which said two rotatable pucks are identified as being in each of said odd numbered plurality of distinct positions relative to said frame, said openings in said top surface and said bottom surface of each of said two rotatable pucks being located in each of said two rotatable pucks in an approximately straight line of openings so that a straight line may be drawn approximately through a center of each said opening and through said approximately vertical center of rotation of each said two rotatable pucks, said odd numbered plurality of distinct positions of each of said two rotatable pucks being identified as a center position and positions counterclockwise from a center position and positions clockwise from said center position, said positions counterclockwise and said positions clockwise from center being viewed from the same point of reference for both said rotatable pucks, said center position being such that when each of said two rotatable pucks is in said center position said approximately straight line of openings is approximately parallel to a line normal to said left side of said frame, said center positions being such that when each of said two rotatable pucks is in said center position each said openings in said top surfaces of said two rotatable pucks align with one of said openings in said top surface of said rotatable puck cavities, said counterclockwise positions being such that each of said openings located in said bottom surface of said two rotatable pucks that are on a first side of said approximately vertical center of rotation align with one of said openings in said bottom surface of said rotatable puck cavities that are formed by said passageways that also form said openings in said top surface of said lower moveable puck(s) cavity in a first half of said rows of said openings in said top surface of said lower moveable puck(s) cavity located closer to said front side of said frame than a second half of said rows of said openings in said top surface of said lower moveable puck(s) cavity and each of said openings located in said bottom surface of said two rotatable pucks that are on a second side of said approximately vertical center of rotation align with one of said openings in said bottom surface of said rotatable puck cavities that are formed by said passageways that also form said openings in said top surface of said lower moveable puck(s) cavity in a first half of said rows of said openings in said top surface of said lower moveable puck(s) cavity located closer to said back side of said frame than a second half of said rows of said openings in said top surface of said lower moveable puck(s) cavity, said clockwise positions being such that each of said openings located in said bottom surface of said two rotatable pucks that are on said first side of said approximately vertical center of rotation align with one of said openings in said bottom surface of said rotatable puck cavities that are formed by said passageways that also form said openings in said top surface of said lower moveable puck(s) cavity in a first half of said rows of said openings in said top surface of said lower moveable puck(s) cavity located closer to said back side of said frame than a second half of said rows of said openings in said top surface of said lower moveable puck(s) cavity and each of said openings located in said bottom surface of said two rotatable pucks that are on said second side of said approximately vertical center of rotation align with one of said openings in said bottom surface of said rotatable puck cavities that are formed by said passageways that also form said openings in said top surface of said lower moveable puck(s) cavity in a first half of said rows of said openings in said top surface of said lower moveable puck(s) cavity located closer to said front side of said frame than a second half of said rows of said openings in said top surface of said lower moveable puck(s) cavity;

u. said top surfaces of said two rotatable pucks being such that when said two rotatable pucks are in said clockwise and said counterclockwise positions said top surfaces of said two rotatable pucks cover said openings in said upper surface of said rotatable pucks cavities so that any game objects in said passageways that form said openings in said upper surface of said rotatable puck cavities remain in said passageways;

v. said two rotatable pucks being secured to said frame by a means that allows for rotation of said two rotatable pucks, said means for securing said two rotatable pucks to said frame being of a nature that retains said two rotatable pucks in their positions with sufficient accuracy that said openings in said two rotatable pucks align with said openings in said frame;

w. said lower moveable puck(s) cavity being of a size in a direction approximately parallel to a line normal to said front side of said frame that allows said lower moveable puck(s) to be moved between and to three distinct positions in a direction approximately parallel to a line normal to said front side of said frame, said three distinct positions being so that a distance between any two positions of said distinct positions is approximately equal to a half of a distance between any two even numbered plurality of approximate rows of said openings in said top surface of said lower moveable puck(s) cavity, said game apparatus having a means by which said lower moveable puck(s) are identified as being in each of said three distinct positions relative to said frame, said three positions being identified as a back position a center position and a front position, said back position being so that when said lower moveable puck(s) including said odd game object puck are in said back position said lower moveable puck(s) are closer to said back side of said frame than when in said center position, said front position being so that when said lower moveable puck(s) including said odd game object puck are in said front position said lower moveable puck(s) are closer to said front side of said frame than when in said center position;

x. said one or a plurality of lower moveable puck(s) being such that when there is only one lower moveable puck it is said odd game object puck, said one or a plurality of lower moveable puck(s) being such that when there is more than one of said lower moveable puck(s) said lower moveable puck(s) are arranged in a pattern where said pucks are approximately side by side in a direction approximately parallel to a line drawn perpendicular to said left side of said frame;

y. said lower moveable puck(s) being such that when said lower moveable puck(s) are in said center position said lower moveable puck(s) contain said passageways forming said openings in said bottom surface(s) of said lower moveable puck(s) of sufficient number and position that said openings align one to one to said openings in said bottom surface of said lower moveable puck(s) cavity, said alignment being such that for each said complete column and each said incomplete column of openings in said bottom surface of said lower moveable puck(s) cavity there are equivalent complete and incomplete columns of said openings in said top surface and said bottom surface of said lower moveable puck(s), said odd game object puck being such that a subset of said openings in said bottom surface of said odd game object puck or all of said openings in said bottom surface of said odd game object puck align with all of said openings in said bottom surface of said lower moveable puck(s) cavity in said incomplete columns when said odd game object puck is in said center position;

z. said openings in each said incomplete column in said top surface of said odd game object puck being located in said odd game object puck so that when said odd game object puck is in said center position each said opening(s) in said bottom surface of said fourth thickness of material of said upper moveable puck align with a first opening of two of said openings in each said incomplete column in said top surface of said odd game object puck or a second opening of two of said openings in each said incomplete column in said top surface of said odd game object puck when said upper moveable puck is moved a distance in a first direction or an approximately equal distance to said distance in a second direction from said center position to a first said distinct position or a second said distinct position where said first said distinct position and said second said distinct position are an even plurality of distinct positions from said center distinct position of said upper moveable puck, said back position of said odd game object puck being such that when said odd game object puck is in said back position each said opening in each said incomplete column in said top surface of said odd game object puck closer to said front side of said frame aligns with one of said openings in said bottom surface of said fourth thickness of material of said upper moveable puck when said upper moveable puck is moved a distance towards said front side of said frame that is less than a distance required to align said openings in said bottom surface of said fourth thickness of material of said upper moveable puck to said openings in each said incomplete column in said upper surface of said odd game object puck when said odd game object puck is in said center position by a distance that is approximately equal to a distance between any two adjacent said distinct positions of said upper moveable puck, said front position of said odd game object puck being such that when said odd game object puck is in said front position each said opening in each said incomplete column in said top surface of said odd game object puck closer to said back side of said frame aligns with each said opening in said bottom surface of said fourth thickness of material of said upper moveable puck when said upper moveable puck is moved a distance towards said back side of said frame that is less than a distance required to align said openings in said bottom surface of said fourth thickness of material of said upper moveable puck to said openings in each said incomplete column in said upper surface of said odd game object puck when said odd game object puck is in said center position by a distance that is approximately equal to a distance between any two adjacent said distinct positions of said upper moveable puck;

aa. said columns of said openings in said top surface(s) of said lower moveable puck(s) being positioned so that for each said column of said openings in said top surface of said lower moveable puck(s) cavity there is one said column of said openings in said top surface of said lower moveable puck(s) with a same approximate position in the left side to right side direction of said frame;

bb. said front position of said lower moveable puck(s) being such that when said lower moveable puck(s) are in said front position all but a one of said openings of said passageways in each said complete column in said top surface of said lower moveable puck(s) that are closer to said back side of said frame than said one of said openings in said column align with one of any said openings of said passageways in each said column in said same approximate left side to right side direction of said frame that are present in said rows of openings in said top surface of said lower moveable puck(s) cavity;

cc. said back position of said lower moveable puck(s) being such that when said lower moveable puck(s) are in said back position all but a one of said openings of said passageways in each said complete column in said top surface of said lower moveable puck(s) that are closer to said front side of said frame than said one of said openings in said column align with one of any said openings of said passageways in each said column in said same approximate left side to right side direction of said frame that are present in said rows of openings in said top surface of said lower moveable puck(s) cavity;

dd. said top surface of said odd game object puck being such that when said openings in said bottom surface of said fourth thickness of material and said openings in said top surface of said odd game object puck do not align said top surface of said odd game object puck covers said openings of said passageways in said bottom surface of said fourth thickness of material of said upper moveable puck so that any said game objects in said passageways forming said openings in said bottom surface of said fourth thickness of material remain in said passageways;

ee. said top surfaces of said lower moveable puck(s) being such that when said lower moveable puck(s) are in said center position said top surfaces of said lower moveable puck(s) cover said openings of said passageways in said top surface of said lower moveable puck(s) cavity so that any game objects in said passageways forming said openings in said bottom side of said lower moveable puck(s) cavity remain in said passageways;

ff. said lower moveable puck(s) cavity being of a size in all directions other than in a horizontal direction parallel to a horizontal line normal to said front side of said frame that it retains said lower moveable puck(s) with sufficient accuracy that said openings in said lower moveable puck(s) align with said openings in said top surface of said lower moveable puck(s) cavity and said openings in said bottom surface of said lower moveable puck(s) cavity and said openings in said bottom surface of said fourth thickness of material when aligned;

gg. said even numbered plurality of assemblies being such that it can be divided into two equal subsets, each said subset being such that for each said assembly in a first said subset of a first form there is an assembly in a second said subset of a second said form where said first form and said second form are approximately a same form, said same form being such that both said assemblies have an equal number of said sliding bodies located in a same position in each said assembly with a same number of said passageways in each said sliding body, said assemblies of said same form from said equal subsets being a matched pair of assemblies;

hh. each specific passageway of said passageways in said sliding bodies being associated with a specific passageway in said two rotatable pucks, said association being established by an alignment of the specific opening of said specific passageway of said passageways in said sliding bodies in said bottom of a specific sliding body and a specific opening of said openings in said bottom surface of said sliding body cavities of a specific sliding body cavity of a specific passageway in said first thickness of material when said specific sliding body is in said second position and an alignment of a specific opening in said top surface of a specific rotatable puck cavity of said specific passageway in said first thickness of material and a specific opening of said specific passageway in said two rotatable pucks when said rotatable pucks are in said center position;

ii. all such said matched pairs of said assemblies being such that for a first said passageway in a first rotatable puck of said two rotatable pucks associated with a first passageway in a first sliding body in a first assembly of said assemblies within said matched pair there is a second passageway in a second rotatable puck of said two rotatable pucks associated with a second passageway in a second sliding body in a second assembly of said assemblies within said matched pair that is on an opposite side of said second rotatable puck relative to said approximately vertical center of rotation of said second rotatable puck as said first said passageway is on said first rotatable puck relative to said approximately vertical center of rotation of said first rotatable puck;

jj. said upper moveable puck and said two rotatable pucks and said assemblies and said lower moveable pucks and said frame being formed so that they encompass all said passageways sufficiently to retain said game objects within said passageways;

kk. said game apparatus having a means by which rotational movement of either specific rotated rotatable puck of said two rotatable pucks from one said distinct position to another adjacent said distinct position of only one rotational direction will cause movement of said upper moveable puck from one said distinct position to another said distinct position in a same or an opposite direction as a surface of said specific rotated rotatable puck moves that is located closer to said moveable puck than said approximately vertical center of rotation of said rotatable puck parallel to a line normal to said front side of said frame when said specific rotated rotatable puck is rotated except when said upper moveable puck is in a last of said odd numbered plurality of distinct positions in said direction;

ll. said alignments of said openings being such that any first said game object that is introduced into any first said passageway in any said sliding body or any first said passageway extending from said top side of said frame to said upper moveable puck cavity and subsequently moved through said alignments of said openings and through said passageways of said game apparatus by movement of said rotatable pucks and said moveable pucks and by force of gravity will not occupy a same said passageway as any second said game object that is introduced into any second said passageway in any said sliding body or any second said passageway extending from said top side of said frame to said upper moveable puck cavity and subsequently moved through said alignments of said openings and through said passageways of said game apparatus by movement of said rotatable pucks and said moveable pucks and by force of gravity;

mm. said passageways being of sufficient size for said game objects to pass into through and out of by force of gravity, said passageways being of sufficient size for said game objects to reside entirely within, said passageways being such that no said passageway connects to another said passageway;

nn. said alignments of said openings being sufficient to allow game objects to pass between said two passageways by force of gravity;

oo. a means by which said pucks and said assemblies can be moved relative to said frame from outside said frame;

pp. a number of even hole assemblies and a number of odd hole assemblies, said number of odd hole assemblies being one less than said number of even hole assemblies, said assemblies being positioned in a stack directly below said frame, said stack consisting of one of said even hole assemblies positioned directly below said frame and a number of odd hole assembly and even hole assembly pairs directly below said one of even hole assemblies, said odd hole assembly and even hole assembly pairs consisting of one of said odd hole assemblies stacked directly on top of one of one said even hole assemblies;

qq. each said odd hole assemblies each having one or a plurality of odd hole movable puck(s), an odd hole frame sufficient to hold said odd hole movable puck(s);

rr. each said even hole assemblies each having one or a plurality of even hole movable puck(s), an even hole frame sufficient to hold said even hole movable puck(s);

ss. said odd hole moveable puck(s) and said even hole movable puck(s) having a top surface and a bottom surface, said odd hole moveable puck(s) and said even hole movable puck(s) being positioned in each respective said odd hole frames and each respective said even hole frames so that said top surface(s) and said bottom surface(s) of each said odd hole moveable puck(s) and each said even hole movable puck(s) are adequately horizontal relative to the force of gravity to allow said game objects to pass through them due to the force of gravity, each said odd hole moveable puck(s) and each said even hole movable puck(s) having a plurality of passageways, said passageways extending from said top surface(s) to said bottom surface(s) of said odd hole moveable puck(s) and said even hole movable puck(s), said passageways forming openings in said top surface(s) and said bottom surface(s) of said odd hole moveable puck(s) and said even hole movable pucks;

tt. each said odd hole frames and each said even hole frames being of a form with a top side and a bottom side, said top side being of a form suitable to join with said frame stacked directly above it, said bottom side being of a form suitable to join with said frame stacked directly below it, said top side being positioned so that the force of gravity is directed against and approximately normal to a plane defined by said top side, each said odd hole frames and each said even hole frames being of a form with a front side and a back side and a left side and a right side, all said odd hole frames and all said even hole frames being positioned so that said front side of all said odd hole frames and all said even hole frames are approximately parallel with said front side of said frame, all said odd hole frames and all said even hole frames being positioned so that said left side of said odd hole frames and said even hole frames are approximately parallel with said left side of said frame;

uu. each said odd hole frame having a odd hole moveable puck(s) cavity forming an opening at said top side of each said odd hole frame, each said odd hole moveable puck(s) cavity being of a size sufficient to contain all of said odd hole moveable puck(s) that are part of said assembly, each said odd hole moveable puck(s) being within said odd hole moveable puck(s) cavity of said assembly, each said odd hole moveable puck(s) cavity being open on said top side of each said odd hole frame sufficiently so that said passageways in said odd hole moveable puck(s) are accessible by said assembly directly above;

vv. each said even hole frames having a even hole moveable puck(s) cavity forming an opening at said top side of each said even hole frames, each said even hole moveable puck(s) cavity being of a size sufficient to contain all of said even hole moveable puck(s) that are part of said assembly, each said even hole moveable puck(s) being within said even hole moveable puck(s) cavity of said assembly, each said even hole moveable puck(s) cavity being open on said top side of each said even hole frame sufficiently so that said passageways in said even hole moveable puck(s) are accessible by said assembly directly above;

ww. each said odd hole frame having a fifth thickness of material below said odd hole moveable puck(s) cavity, said fifth thickness of material extending from said odd hole moveable puck(s) cavity to said bottom side of said odd hole frame, said fifth thickness of material having a plurality of passageways, said passageways extending from said odd hole moveable puck(s) cavity to said bottom side of said odd hole frame, said passageways forming openings in said bottom surface of said odd hole moveable puck(s) cavity, said passageways forming openings in said bottom side of said odd hole frame, said passageways being such that said openings in said bottom surface of said odd hole moveable puck(s) cavity and said openings in said bottom side of said odd hole frame are arranged in a horizontal plane in both a plurality of approximate rows and a plurality of approximate columns, said rows being approximately parallel to a line normal to said left side of said odd number frame, said columns being approximately parallel to a line normal to said front side of said odd hole frame, said rows being so that a first distance between any two of said rows is approximately equal to a second distance between any other two of said rows, said rows being so that a distance between any two rows of said rows is approximately equal to a distance between any two of said even numbered plurality of approximate rows of said openings in said top surface of said lower moveable puck(s) cavity, a total number of said columns being equal to a total number of complete and incomplete columns in said bottom of said lower moveable puck(s) cavity, said rows being of an odd numbered plurality of rows, said rows being positioned in said front side to said back side direction of said frame so that a center row of said odd numbered plurality of rows is approximately aligned with said center row of said approximate rows of said complete columns on said bottom side of said frame;

xx. each said even hole frame having a sixth thickness of material below said even hole moveable puck(s) cavity, said sixth thickness of material extending from said even hole moveable puck(s) cavity to said bottom side of said even hole frame, said sixth thickness of material having a plurality of passageways, said passageways extending from said even hole moveable puck(s) cavity to said bottom side of said even hole frame, said passageways forming openings in said bottom surface of said even hole moveable puck(s) cavity, said passageways forming openings in said bottom side of said even hole frame, said passageways being such that said openings in said bottom surface of said even hole moveable puck(s) cavity and said openings in said bottom side of said even hole frame are arranged in a horizontal plane in both a plurality of approximate rows and a plurality of approximate columns, said rows being approximately parallel to a line normal to said left side of said even number frame, said columns being approximately parallel to a line normal to said front side of said even hole frame, said rows being so that a first distance between any two of said rows is approximately equal to a second distance between any other two of said rows, said rows being so that a distance between any two rows of said rows is approximately equal to a distance between any two of said even numbered plurality of approximate rows of said openings in said top surface of said lower moveable puck(s) cavity, a total number of said columns being equal to a total number of complete and incomplete columns in said bottom of said lower moveable puck(s) cavity, said rows being of an even numbered plurality of rows, said rows being positioned in said front side to said back side direction of said frame so that a second half of said rows is closer to said back side of said even hole frame than said center row of said complete columns in said bottom surface of said lower moveable puck(s);

yy. each said odd numbered plurality of rows in each said odd hole assemblies and each said even numbered plurality of rows in each said even hole assemblies being a number where said number differs from said number of rows in said assembly directly above and directly below itself by only one;

zz. said odd hole moveable puck(s) cavity and said even hole movable puck(s) cavity being of a size in a direction approximately parallel to a line normal to said front side of said odd hole frames and said even hole frames that allows said odd hole movable puck(s) and said even hole moveable puck(s) to be moved between and to three distinct positions in a horizontal direction approximately parallel to a horizontal line normal to said front side of said odd hole frames and said even hole frames, said three distinct positions being so that a distance between any two positions of said distinct positions is approximately equal to a half of a distance between any two of said even numbered plurality of approximate rows of said openings in said top surface of said lower moveable puck(s) cavity;

aaa. said game apparatus having a means by which said odd hole moveable puck(s) and said even hole movable puck(s) are identified as being in each of said three distinct positions relative to said odd hole frames and said even hole frames, said three positions being identified as a back position a center position and a front position, said back position being so that when said odd hole moveable puck(s) and said even hole movable puck(s) are in said back position said odd hole moveable puck(s) and said even hole movable puck(s) are closer to said back side of said second frame than when in said center position, said front position being so that when said odd hole moveable puck(s) and said even hole movable puck(s) are in said front position said odd hole moveable puck(s) and said even hole movable puck(s) are closer to said front side of said second frame than when in said center position;

bbb. said one or a plurality of said odd hole moveable puck(s) and said even hole movable puck(s) being such that when there is more than one said odd hole moveable puck(s) and said even hole movable puck(s) said odd hole moveable puck(s) and said even hole movable puck(s) are arranged in a pattern where said pucks are side by side in a direction approximately parallel to a line normal to said left side of said odd hole frames and said even hole frames;

ccc. said odd hole moveable puck(s) and said even hole movable puck(s) being such that when said odd hole moveable puck(s) and said even hole movable puck(s) are in said center position said odd hole moveable puck(s) and said even hole movable puck(s) contain said passageways with said openings of sufficient number and position that said openings in said bottom surface(s) said odd hole moveable puck(s) and said even hole movable puck(s) align one to one to said openings in said bottom surface of said odd hole moveable puck(s) cavity and said even hole movable puck(s) cavity, said alignment being such that for each said column of openings in said bottom surface of said odd hole moveable puck(s) cavity and said even hole movable puck(s) cavity there is an equivalent column of said openings in said top surface and said bottom surface of said odd hole moveable puck(s) and said even hole movable pucks;

ddd. said columns of said openings in said top surface of said odd hole moveable puck(s) and said even hole movable puck(s) being positioned so that for each said column in said bottom side of said frame there is one column of said openings in said top surface of said odd hole moveable puck(s) and said even hole movable puck(s) with a same approximate position in said left side to right side direction of said frame;

eee. said front position of said odd hole moveable puck(s) and said even hole movable puck(s) being such that when said odd hole moveable puck(s) and said even hole movable puck(s) are in said front position all but a one of said openings of said passageways in each said column in said top surface of said odd hole moveable puck(s) and said even hole movable puck(s) that are closer to said back side of said odd hole frame and even hole frame than said one of said openings of said passageways in each said column each align with one of said openings of said passageways in each said column in said same approximate left side to right side direction of said odd hole frame and said even hole frame in said bottom side of said frame directly above said odd hole assembly and said even hole assembly;

fff. said back position of said odd hole moveable puck(s) and said even hole movable puck(s) being such that when said odd hole moveable puck(s) and said even hole movable puck(s) are in said back position all but a one of said openings of said passageways in each said column in said top surface of said odd hole moveable puck(s) and said even hole movable puck(s) that are closer to said front side of said odd hole frame and said even hole frame than said one of said openings of said passageways in each said column each align with one of said openings of said passageways in each said column in said same approximate left side to right side direction of said odd hole frame and said even hole frame in said bottom side of said frame directly above said odd hole assembly and said even hole assembly;

ggg. said top surfaces of said odd hole moveable puck(s) and said even hole movable puck(s) being such that when said odd hole moveable puck(s) and said even hole movable puck(s) are in said center position said top surfaces of said odd hole moveable puck(s) and said even hole movable puck(s) cover said openings of said passageways in said bottom side of said frame directly above so that any game objects in said passageways remain in said passageways;

hhh. said odd hole moveable puck(s) cavity and said even hole movable puck(s) cavity being of a size in all directions other than in a horizontal direction parallel to a horizontal line normal to said front side of said frame that it retains said odd hole moveable puck(s) and said even hole movable puck(s) with sufficient accuracy that said openings in said odd hole moveable puck(s) and said even hole movable puck(s) align with said openings in said bottom side of said frame directly above said frames containing said odd hole moveable puck(s) and said even hole movable puck;

iii. said odd hole moveable puck(s) and said even hole movable puck(s) and said odd hole frames and said even hole frames being formed so that they encompass all said passageways sufficiently to retain said game objects within said passageways;

jjj. said alignments of said openings being such that any first said game object that is introduced into any first said passageway in said odd hole moveable puck(s) and said even hole movable puck(s) and subsequently moved through said alignments of said openings and through said passageways of said game apparatus by movement of said moveable puck(s) and by force of gravity will not occupy a same said passageways as any second said game object that is introduced into any second said passageway in any said odd hole moveable puck(s) and said even hole movable puck(s) and subsequently moved through said alignments of said openings and through said passageways of said game apparatus by movement of said moveable puck(s) and by force of gravity;

kkk. said passageways being of sufficient size for said game objects to pass into through and out of by force of gravity, said passageways being of sufficient size for said game objects to reside entirely within, said passageways being such that no said passageway connects to another said passageway;

lll. said alignments of said openings being sufficient to allow game objects to pass between said two passageways by force of gravity;

mmm. a means by which said odd hole moveable puck(s) and said even hole movable puck(s) can be moved relative to said frame from outside said frame;

nnn. a means by which a number of exclusive pairs of said lower moveable puck(s) and said odd hole moveable puck(s) and said even hole movable puck(s) within said game apparatus are linked so that when a first said moveable puck of a pair of said pairs of said lower moveable puck(s) and said odd hole moveable puck(s) and said even hole movable puck(s) is in said front position a second said moveable puck of a pair of said pairs of said lower moveable puck(s) and said odd hole moveable puck(s) and said even hole movable puck(s) is in said back position and when said first said moveable puck of said pair of said pairs of said lower moveable puck(s) and said odd hole moveable puck(s) and said even hole movable puck(s) is in said center position said second said moveable puck of said pair of said pairs of said lower moveable puck(s) and said odd hole moveable puck(s) and said even hole movable puck(s) is in said center position and when said first said moveable puck of said pair of said pairs of said lower moveable puck(s) and said odd hole moveable puck(s) and said even hole movable puck(s) is in said back position said second said moveable puck of said pair of said pairs of said lower moveable puck(s) said odd hole moveable puck(s) and said even hole movable puck(s) is in said front position, where each member of the pair is in a different frame than the other member of said pair.

* * * * *